US007673870B2

(12) United States Patent
Koga et al.

(10) Patent No.: US 7,673,870 B2
(45) Date of Patent: Mar. 9, 2010

(54) IMAGE FORMING APPARATUS PROVIDED WITH FEEDING ROLLER HAVING PLAY IN ROTATING DIRECTION

(75) Inventors: Yuji Koga, Nagoya (JP); Daisuke Kozaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 83 days.

(21) Appl. No.: 11/614,794

(22) Filed: Dec. 21, 2006

(65) Prior Publication Data

US 2007/0158896 A1 Jul. 12, 2007

(30) Foreign Application Priority Data

Dec. 22, 2005 (JP) ..... 2005-370240

(51) Int. Cl.
*B65H 5/00* (2006.01)

(52) U.S. Cl. ..... 271/10.11; 271/10.09; 271/10.13; 271/122; 271/124; 271/125

(58) Field of Classification Search ..... 271/10.09, 271/10.11, 10.13, 122, 124, 125
See application file for complete search history.

(56) References Cited

U.S. PATENT DOCUMENTS

| | | | | |
|---|---|---|---|---|
| 3,961,786 | A * | 6/1976 | Yanker | 271/122 |
| 5,624,109 | A * | 4/1997 | Tanaka | 271/10.13 |
| 5,749,569 | A * | 5/1998 | Atsumi et al. | 271/10.11 |
| 5,755,435 | A * | 5/1998 | Fujiwara | 271/4.04 |
| 6,241,237 | B1 * | 6/2001 | Bokelman | 271/9.11 |
| 6,758,468 | B2 * | 7/2004 | DaCunha et al. | 271/35 |
| 7,354,038 | B2 * | 4/2008 | Watase | 271/10.13 |
| 2004/0021262 | A1 * | 2/2004 | Yen et al. | 271/10.11 |
| 2004/0155397 | A1 * | 8/2004 | Gaarder et al. | 271/10.11 |
| 2006/0071389 | A1 * | 4/2006 | Kozaki et al. | 271/9.11 |
| 2007/0001369 | A1 * | 1/2007 | Murrell et al. | 271/10.11 |
| 2007/0057447 | A1 * | 3/2007 | Asada et al. | 271/272 |

(Continued)

FOREIGN PATENT DOCUMENTS

| | | |
|---|---|---|
| JP | S59-64834 U | 4/1984 |

(Continued)

OTHER PUBLICATIONS

Japan Patent Office, Office Action mailed Oct. 28, 2008, in priority Patent Application No. JP 2005-370240.

*Primary Examiner*—Patrick H Mackey
*Assistant Examiner*—Prasad V Gokhale
(74) *Attorney, Agent, or Firm*—Baker Botts L.L.P.

(57) ABSTRACT

A feeding roller is configured to be driven to rotate both in a forward direction for conveying the recording medium to an image forming position along a conveying path and in a reverse direction opposite to the forward direction. A conveying roller is configured to driven to rotate both in a forward direction for allowing passage of the recording medium conveyed by the feeding roller and in a reverse direction for preventing the passage of the recording medium. A transmitting unit is capable of transmitting a rotational driving force to the feeding roller and the conveying roller, in such a manner that either one of the feeding roller and the conveying roller rotates in the forward direction and that the other one of the feeding roller and the conveying roller rotates in the reverse direction. The feeding roller has a predetermined play in a rotational direction.

7 Claims, 27 Drawing Sheets

U.S. PATENT DOCUMENTS

2007/0069451 A1* 3/2007 Iwago et al. ..... 271/186
2007/0102866 A1* 5/2007 Koga et al. ..... 271/10.11

FOREIGN PATENT DOCUMENTS

JP 01181633 A * 7/1989
JP H05-092839 A 4/1993
JP 05132168 A * 5/1993
JP H10-310270 A 11/1998
JP 2000-335758 A 12/2000
JP 2002-046874 A 2/2002
JP 2005-154100 A 6/2005

* cited by examiner

FIG.25

| | INTERMITTENT FEED MODE | | CONTINUOUS FEED MODE |
|---|---|---|---|
| LF MOTOR 6 | REVERSE | FORWARD | FORWARD |
| CONVEYING ROLLER 71 | REVERSE | FORWARD | FORWARD |
| FEEDING ROLLER 60 | FORWARD | REVERSE | FORWARD |

IMAGE FORMING APPARATUS PROVIDED WITH FEEDING ROLLER HAVING PLAY IN ROTATING DIRECTION

CROSS REFERENCE TO RELATED APPLICATIONS

This application claims priority from Japanese Patent Application No. 2005-370240 filed Dec. 22, 2005. The entire content of the priority application is incorporated herein by reference.

TECHNICAL FIELD

The disclosure relates to an image forming apparatus for forming an image on a sheet-like recording medium.

BACKGROUND

Conventionally, some image forming apparatuses, such as printers, are configured so as to have a recording-medium accommodating section (for example, a so-called sheet feed cassette and a sheet feed tray) for accommodating recording mediums such as sheets therein and convey the recording medium accommodated in the recording-medium accommodating section to an image forming position (a position at which an image is formed on a recording medium) Specifically, the image forming apparatuses generally has a configuration including a feeding roller for feeding the recording medium accommodated in the recording-medium accommodating section to a conveying path and a conveying roller for conveying the recording medium after correcting slant by temporarily inhibiting passage of the recording medium conveyed by the feeding roller in the conveying path.

In the configuration of some known image forming apparatuses, miniaturization and reduction in costs are achieved by driving the feeding roller and the conveying roller by a common motor.

For example, Japanese Patent Application Publication No. 2000-335758 discloses a printer in which feed rollers and a conveying roller are driven by a common motor and slant correction is performed by transmitting a rotational driving force so that the conveying roller may rotate in the reverse direction while the feed rollers rotate in a forward direction (a rotational direction for conveying the recording medium to the image forming position). Specifically, the printer has a first sheet supply roller (first sheet feeding roller) for feeding the sheet accommodated in a sheet feed cassette to a conveying path and a second sheet supply roller (second sheet feeding roller) for passing the sheet conveyed by the first sheet supply roller. The printer has a feed roller (conveying roller) for passing the sheet conveyed by the second sheet supply roller after slant correction. The feed roller rotates in the reverse direction in the state where the first sheet supply roller and second sheet supply roller rotatingly conveys the sheet. The rotational direction of a motor is reversed at the timing when the front end of the sheet conveyed by the second sheet supply roller is pushed onto the feed roller. Thereby, the sheet conveyed by the second sheet supply roller is conveyed after slant correction is performed by the feed roller. On the other hand, when the first sheet supply roller conveys the sheet to the second sheet supply roller, the rotational axis of the first sheet, supply roller moves upward so as to separate from the surface of the sheet accommodated in the sheet feed cassette. The second sheet supply roller is configured so as to stop its rotation when the rotational direction of the motor is switched to the reverse direction and turn to a free state. With such configuration, even when the rotational direction of the motor is switched, conveying of the sheet by the feed roller is not prevented by the first sheet supply roller and the second sheet supply roller.

SUMMARY

However, in the printer described in Japanese Patent Application Publication No. 2000-335758, it is necessary to provide a configuration for separating the first sheet supply roller from a sheet and for switching the second sheet supply roller to a free state, in order to perform sheet slant correction by the feed roller while driving the first sheet supply roller, the second sheet supply roller, and the feed roller by the common motor. Consequently, a transmission mechanism for transmitting a rotational driving force of the motor to the first sheet supply roller and the second sheet supply roller becomes complicated.

In view of the foregoing, it is an object of the invention to provide an image forming apparatus capable of performing slant correction of a recording medium by a conveying roller while driving a feeding roller and the conveying roller by a common driving unit with a simple configuration.

In order to attain the above and other objects, the invention provides an image forming apparatus. The image forming apparatus includes a main body, a recording-medium accommodating section, a feeding roller, a conveying roller, a driving unit, and a transmitting unit. The recording-medium accommodating section is provided at the main body and is configured to accommodate a recording medium. The feeding roller is disposed to be in contact with the recording medium accommodated in the recording-medium accommodating section. The feeding roller is configured to be driven to rotate both in a forward direction for conveying the recording medium to an image forming position along a conveying path and in a reverse direction opposite to the forward direction. The conveying roller is disposed on the conveying path. The conveying roller is configured to driven to rotate both in a forward direction for allowing passage of the recording medium conveyed by the feeding roller and in a reverse direction for preventing the passage of the recording medium. The reverse direction is opposite to the forward direction. The driving unit is configured to generate a rotational driving force in both directions. The transmitting unit is capable of transmitting the rotational driving force to the feeding roller and the conveying roller, in such a manner that either one of the feeding roller and the conveying roller rotates in the forward direction and that the other one of the feeding roller and the conveying roller rotates in the reverse direction. The feeding roller has a predetermined play in a rotational direction.

BRIEF DESCRIPTION OF THE DRAWINGS

Illustrative aspects in accordance with the invention will be described in detail with reference to the following figures wherein:

FIG. 25 is a table showing rotational directions (forward/reverse) of the LF motor, conveying roller, and feeding roller in the intermittent feed mode and in the continuous feed mode.

DETAILED DESCRIPTION

Figure 1:
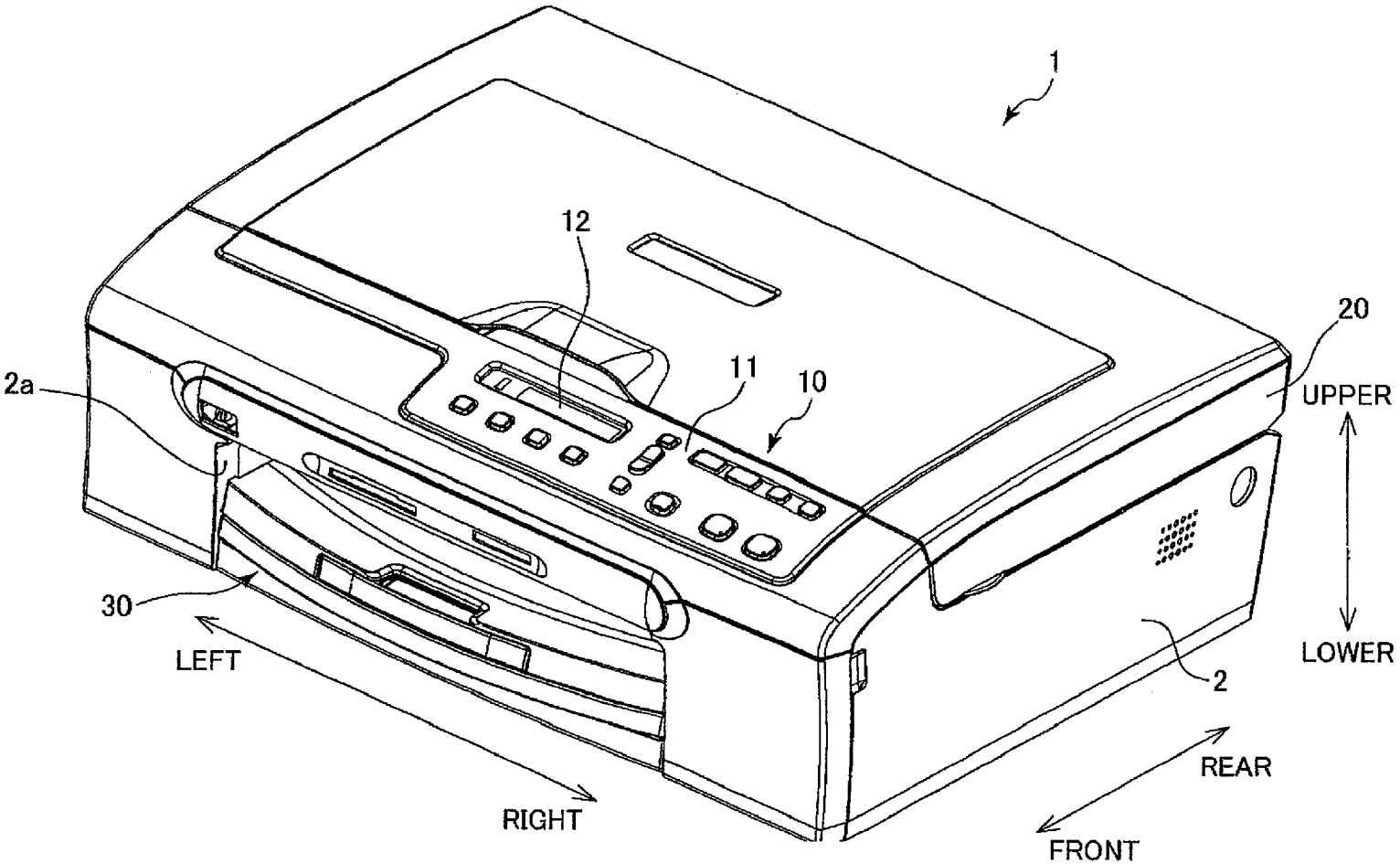
FIG. 1 is a perspective view showing an exterior of an image forming apparatus according to illustrative aspects of the invention.

An image forming apparatus according to some aspects of the invention will be described while referring to the accompanying drawings. In the following description, the expressions "front", "rear", "upper", "lower", "right", "left", and "vertical direction" are used to define the various parts when an image forming apparatus 1 is disposed in an orientation in which it is intended to be used (the state shown in FIG. 1). The front side (near side) is defined as the side on which an operation panel 10 described later is provided. The left and right sides are both sides of the image forming apparatus 1 when viewed from the front side.

[1. Description of Configuration]

The image forming apparatus 1 in the illustrative aspects is a so-called multifunction apparatus having a scanning function, a color-copying function, a facsimile function, in addition to a printing function. As shown in FIG. 17 the exterior of the image forming apparatus 1 is formed of a main casing 2 which is a resin-made rectangular box shaped member.

An operation panel 10 having an operation part 11 on which various operation buttons for input operations are disposed and a display part 12 (for example, a liquid crystal display) for displaying an image such as a message thereon are provided in the front portion on the upper surface of the main casing 2. A scanner unit 20 for reading an image from an original is provided in the rear of the operation panel 10. The scanner unit 20 is used for the scanning function, the color-copying function, and the facsimile function.

Figure 2:
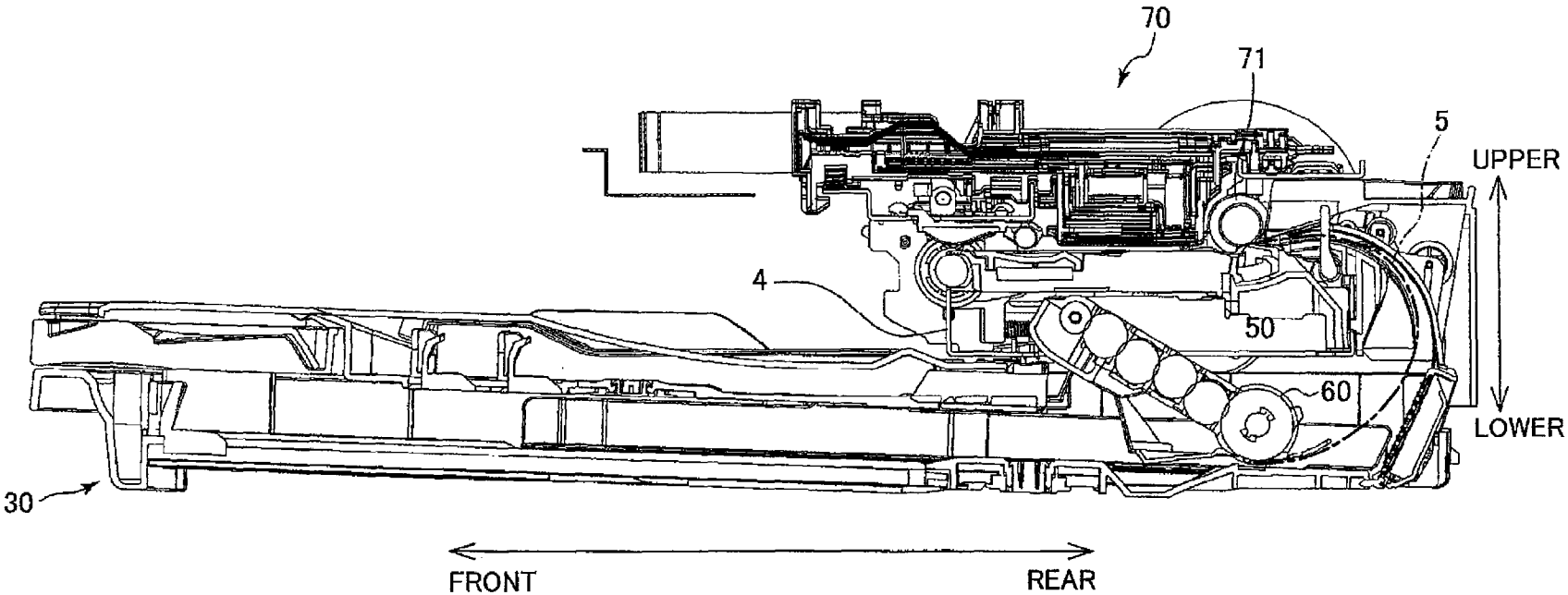
FIG. 2 is a cross-sectional view of a configuration housed in a main casing of the image forming apparatus.

As shown in FIG. 2, a sheet feeding tray 30 which can accommodate a plurality of sheet-like recording mediums such as paper and plastic sheets in a horizontally piled (stacked) state therein is provided in the lower portion of the main casing 2. The sheet feeding tray 30 can be removed by being horizontally pulled out frontward from an opening 2*a* (refer to FIG. 1) formed on the front surface of the main casing 2. The sheet feeding tray 30 can be mounted by being horizontally inserted into the opening 2*a* of the main casing 2.

Figure 9:
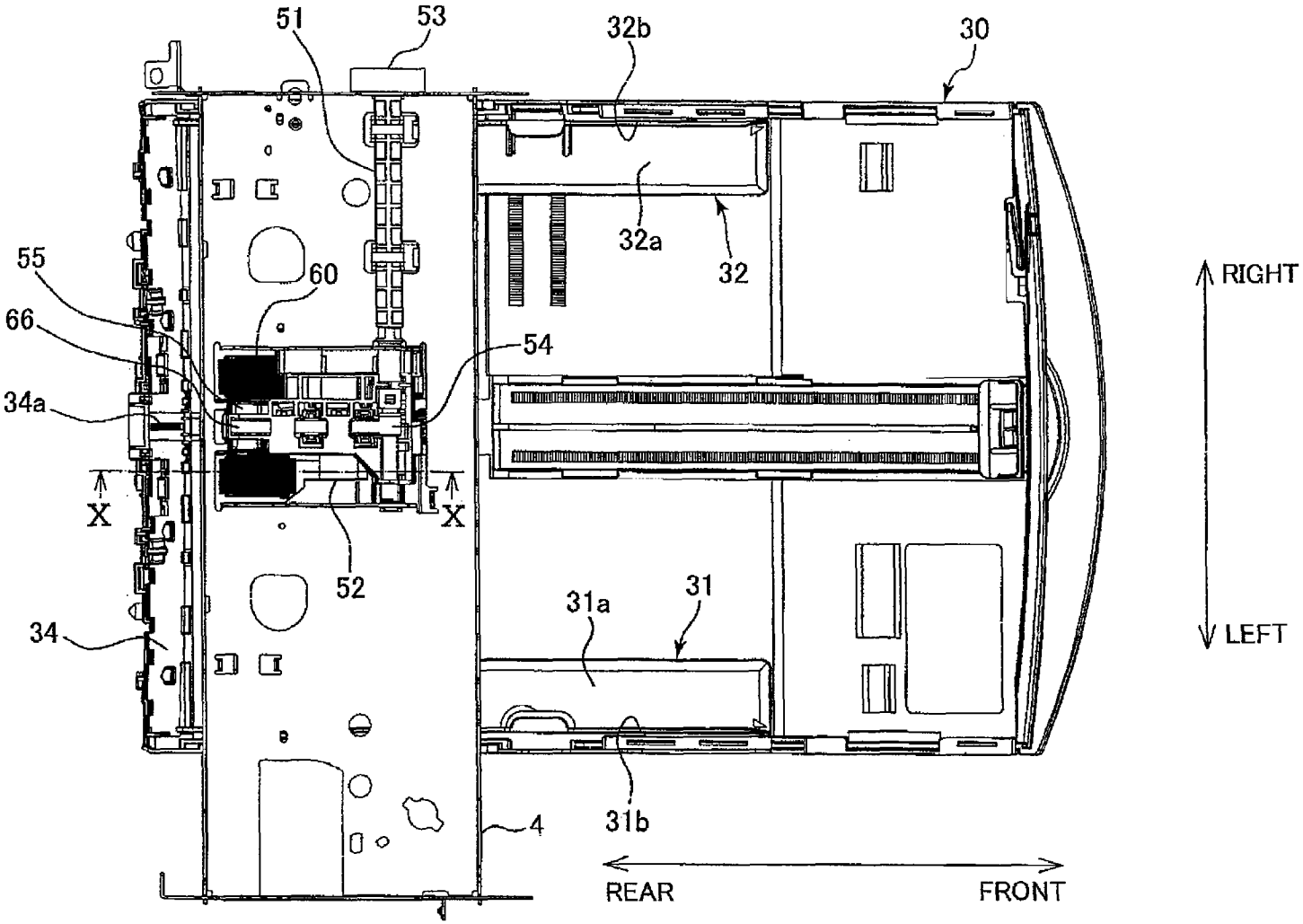
FIG. 9 is a plan view (when viewed from above) of the sheet feeding tray, the sheet feeding unit, and a frame in the state where the second tray is not mounted.

A metal box-like frame 4 which is long in the left-right direction (refer to FIG. 9 and FIG. 11) are provided at the rear portion in the main casing 2 and above the sheet, feeding tray 30. A sheet feeding unit 50 having a feeding roller 60 for feeding (conveying) recording mediums accommodated in the sheet feeding tray 30 one sheet at a time to a conveying path 5 is supported by the frame 4 so as to be disposed above the rear end of the sheet feeding tray 30. That is, the conveying path 5 for guiding the recording medium conveyed rearward from the sheet feeding tray 30 toward the front by turning around the recording medium upward is formed at the rear end of the main casing 2. An image recording unit 70 for recording (printing) an image on the recording medium conveyed while being guided through the conveying path 5 is disposed above the sheet feeding unit 50. The recording medium on which the image is recorded by the image recording unit 70 is discharged to the front portion on the upper surface of the sheet feeding tray 30.

Next, configuration of each part will be described in detail.

[1-1. Configuration of Sheet Feeding Tray]

Figure 3:
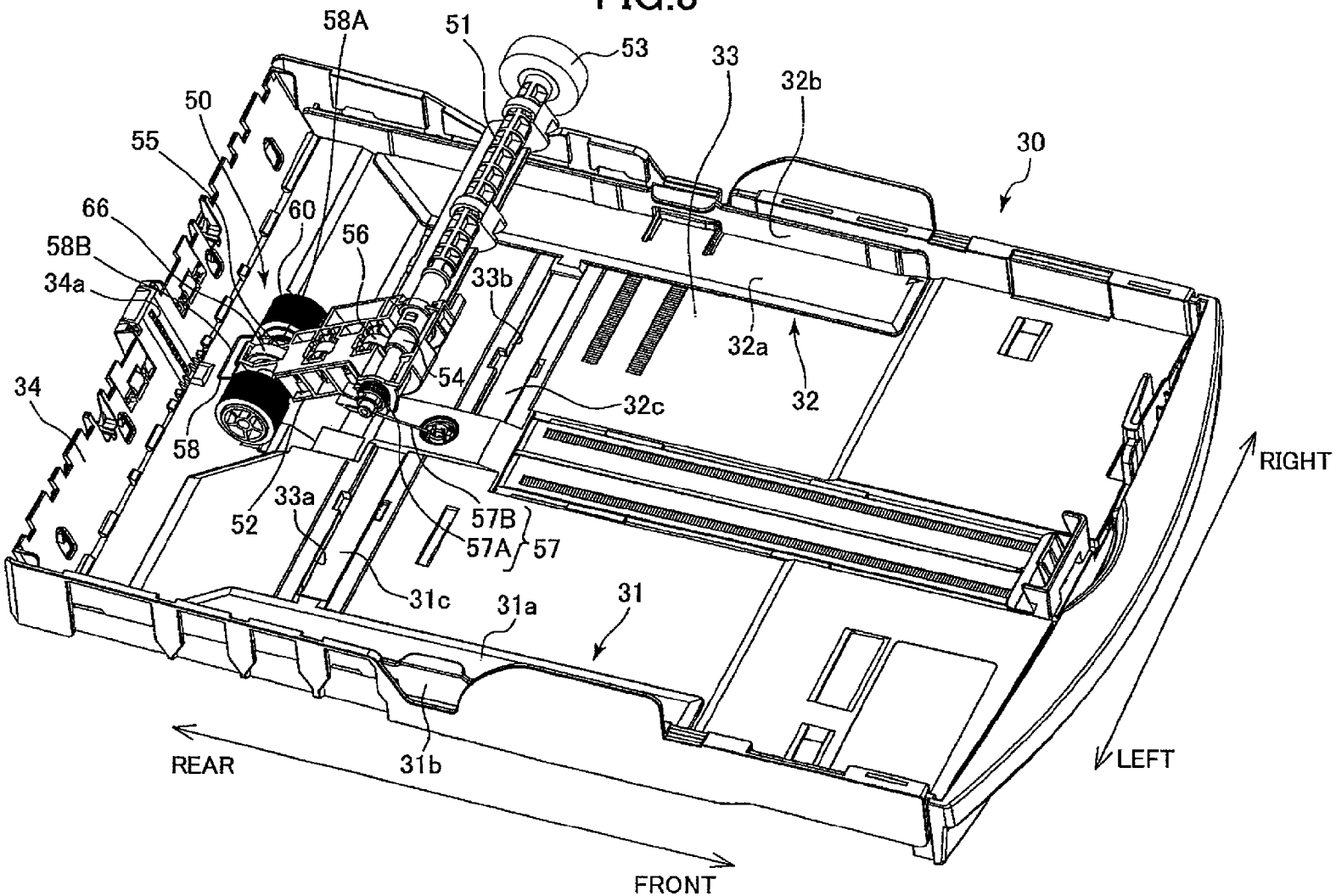
FIG. 3 is a perspective view of a sheet feeding tray and a sheet feeding unit in a state where a second tray is not mounted.
Figure 5:
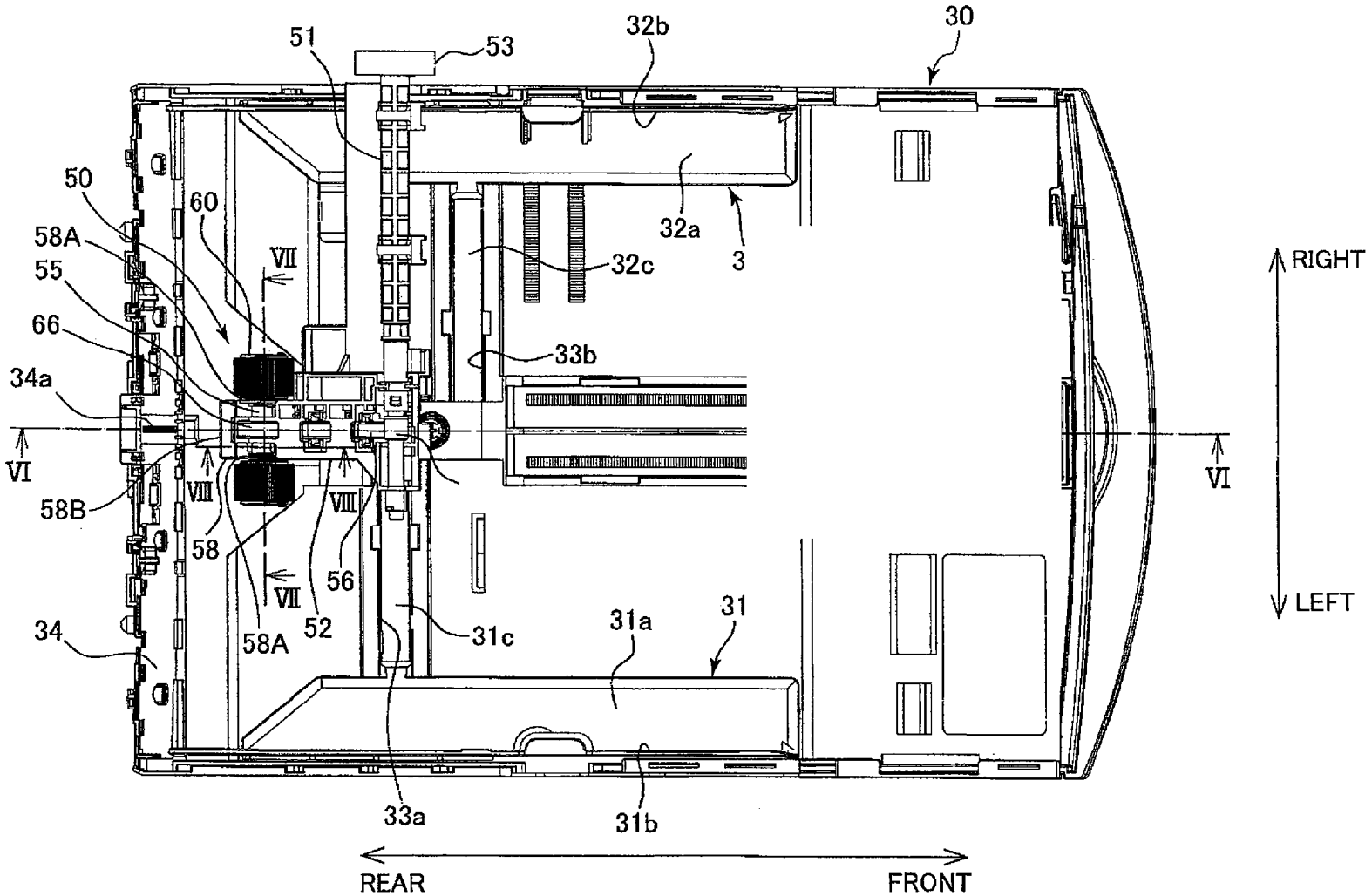
FIG. 5 is a plan view (when viewed from above) of the sheet feeding tray and sheet feeding unit in the state where the second tray is not mounted.

As shown in FIG. 3 and FIG. 5, the sheet feeding tray 30 is a resin-made thin rectangular tray member of approximately A4 size when viewed from above and is configured so as to accommodate a plurality of recording mediums in a stacked state therein. The sheet feeding tray 30 has a pair of side end guides 31 and 32 at the left and right side ends, respectively, and serves to position the recording medium so that position of the center line in the left-right direction (width direction) may be constant irrespective of the size of accommodated recording medium That is, mounting plates 31*a* and 32*a* which mount the recording medium thereon and side plates 31*b* and 32*b* which are erected upward from the outer ends of the mounting plates 31*a* and 32*a* in the left-right direction are provided on the side end guides 31 and 32, respectively. Linear guide bars 31*c* and 32*c* extend from the bottom surfaces of the mounting plates 31*a* and 32*a* toward the other side end guides 31 and 32, respectively. The linear guide bars 31*c* and 32*c* are disposed in parallel with a predetermined distance therebetween in the front-rear direction and engaged into grooves 33*a* and 33*b* formed on a bottom plate 33 of the sheet feeding tray 30 in the left-right direction. The side end guides 31 and 32 can be displaced in the left-right direction by sliding the linear guide bars 31*c* and 32*c* along the grooves 33*a* and 33*b*, respectively. A rack gear is formed on each of opposing sides of the linear guide bars 31*c* and 32*c*. Each rack gear engages with a pinion gear rotatably provided at the center of the bottom plate 33 in the width direction. In other words, the side end guides 31 and 32 are coupled to each other through the rack gears and the pinion gear and operate together so that the distance between the side plate 31*b* and the center line of the sheet feeding tray 30 in the left-right direction may be equal to the distance between the side plate 32*b* and the center line (that is, symmetrically) at all times. As a result, the recording medium can be positioned so that position of its center line may be constant. Here, regions of the side plates 31*b* and 32*b* which contact against the end of the recording medium in the left-right direction are each shaped like a flat surface along the front-rear direction (the direction of conveying the recording medium). For this reason, the recording medium accommodated in the sheet feeding tray 30 in the state where it is positioned by the side end guides 31 and 32 is prevented from moving (displacing) in the left-right direction (the rotational axis direction of the feeding roller 60) and conveyed in the constant direction.

The sheet feeding tray 30 has a guide plate 34 at the rear end. A metal separation member 34*a* is provided at the center of the guide plate 34 in the left-right direction. The separation member 34*a* has a plurality of teeth which are arranged at regular intervals in the vertical direction. The front end of each tooth slightly protrudes from the front surface of the guide plate 34. Thus, a plurality of recording mediums pushed rearward by the feeding roller 60 of the sheet feeding unit 50 come into contact with the front ends of these teeth and the uppermost recording medium is separated.

Figure 4:
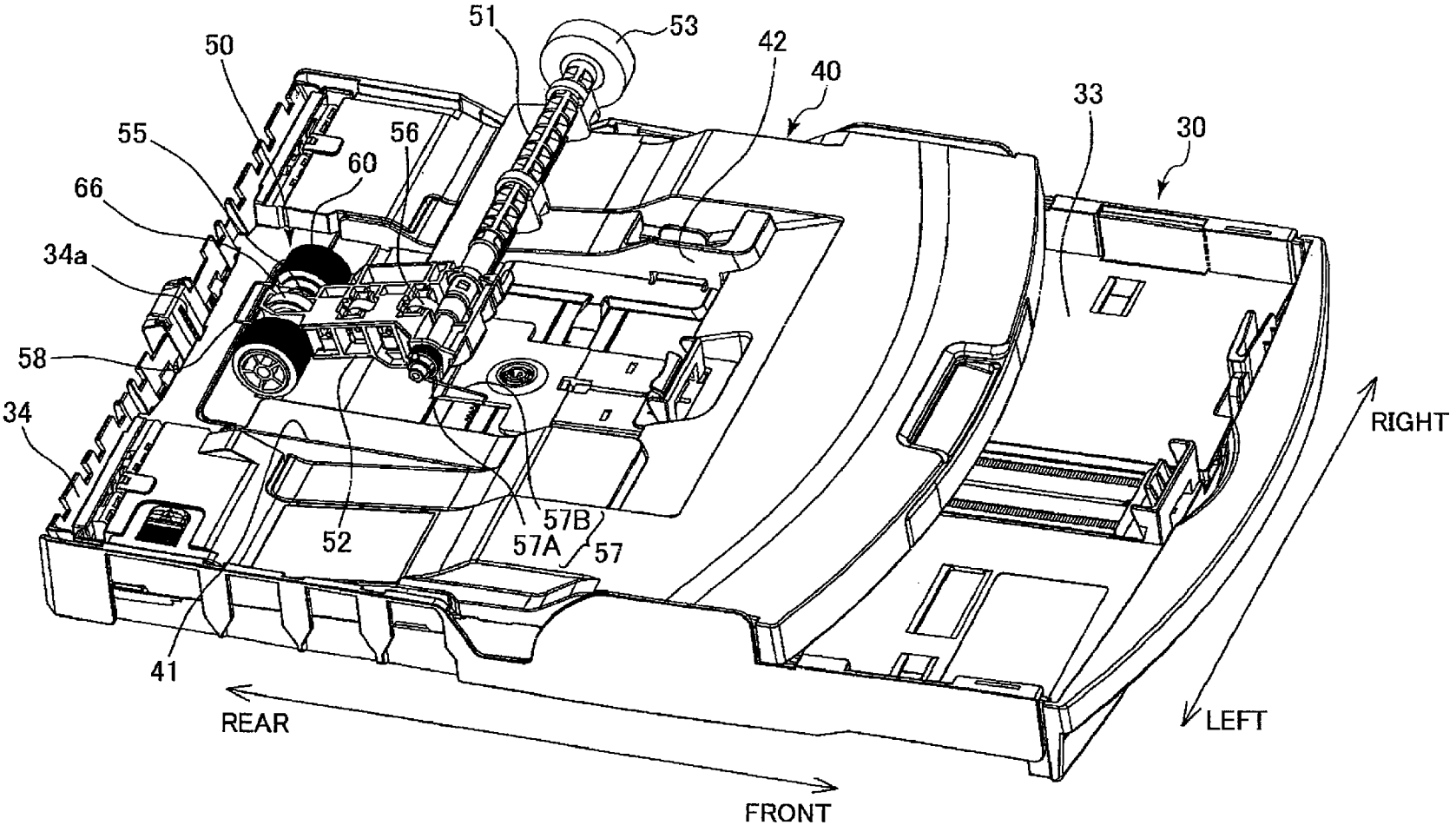
FIG. 4 is a perspective view of the sheet feeding tray and the sheet feeding unit in a state where the second tray is mounted.

As shown in FIG. 4, the sheet feeding tray 30 is configured so that a second tray 40 which can accommodate thick and small-sized recording mediums such as postcards and envelopes at the center in the left-right direction can be mounted/removed from above. The second tray 40 is a resin thin rectangular tray member which is the almost same as the sheet feeding tray 30 in size in the left-right direction and slightly smaller than the sheet feeding tray 30 in the front-rear direction. The second tray 40 can accommodate a plurality of recording mediums in a vertically stacked arrangement. Like the sheet feeding tray 30, the second tray 40 has a pair of side end guides 41 and 42 and serves to position the recording medium so that position of the center line in the left-right direction (width direction) may be constant irrespective of the size of accommodated recording mediums. In the state where the second tray 40 is mounted at a predetermined position in the rear portion on the upper side of the sheet feeding tray 30 (a position shown in FIG. 4), the recording medium accommodated in the second tray 40 is located so that the feeding roller 60 may be prevented from moving toward the sheet feeding tray 30 (downward). For this reason, the feeding roller 60 of the sheet feeding unit 50 comes into contact with the recording medium accommodated in the second tray 40, not the recording medium accommodated in the sheet feeding tray 30 and thus, the recording medium accommodated in the second tray 40 is supplied to the conveying path 5.

[1-2. Configuration of Sheet Feeding Unit]

As shown in FIG. 3 through 5, 9, and 11, the sheet feeding unit 50 has a support shaft 51 supported by the frame 4 so as to be disposed from the center to the right end of the sheet feeding tray 30 in the left-right direction. A large gear 53 is fixed at the right end of the support shaft 51 and a small gear 54 having the same diameter as the support shaft 51 is fixed at the vicinity of the left end of the support shaft 51. The sheet feeding unit 50 is supported by the support shaft 51 and has an arm member 52 configured to be swingable about the support shaft 51 so as to extend obliquely downward toward its free end (rear end). The feeding roller 60 is supported at the rear end (swinging end) of the arm member 52 so as to be rotatable about the rotational axis along the left-right direction. That is, the arm member 52 can swing about a swing axis which is parallel to the rotational axis of the feeding roller 60 and which is located above the recording medium accommodated in the sheet feeding tray 30 and located on an upstream side (front side) in a feeding direction of the recording medium (front to rear) with respect to the rotational axis of the feeding roller 60.

Figure 6A:
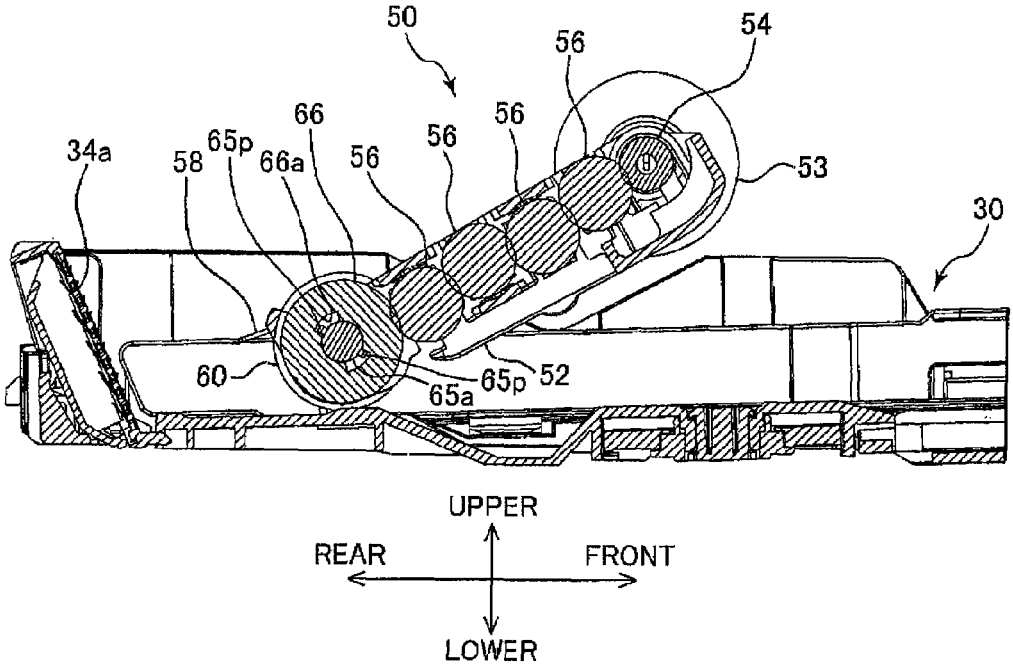
FIG. 6A is a cross-sectional view taken along a line VI-VI in FIG. 5, particularly showing that a feeding roller is not immediately rotated in a reverse direction after switching of rotational direction of a drive gear, due to a play provided in the drive gear.
Figure 6B:
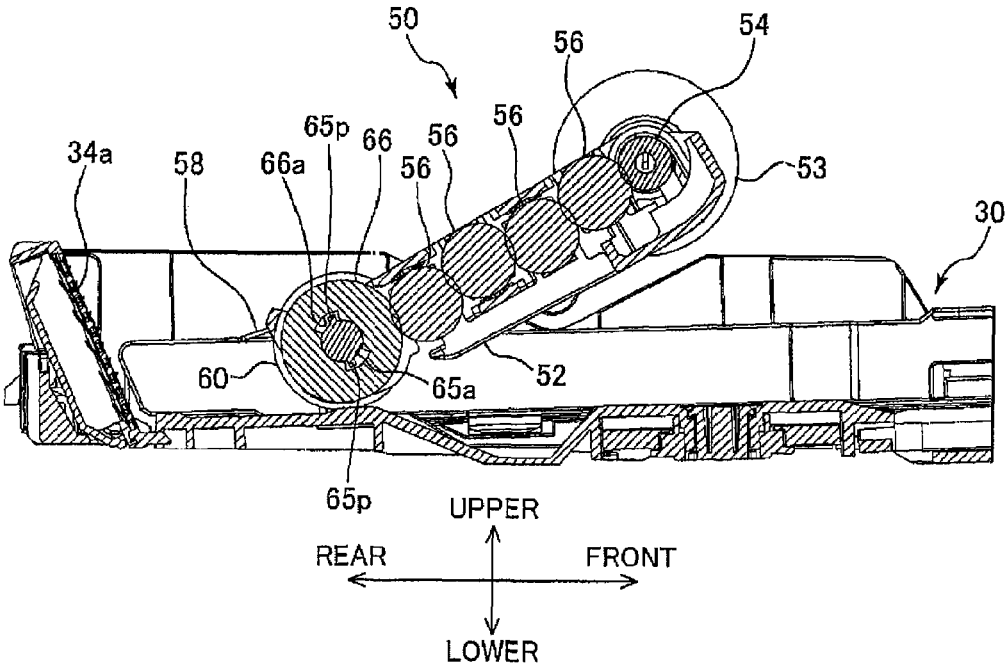
FIG. 6B is a cross-sectional view taken along the line VI-VI in FIG. 5, particularly showing that the feeding roller starts rotating in the reverse direction after a delay for the play.
Figure 7A:
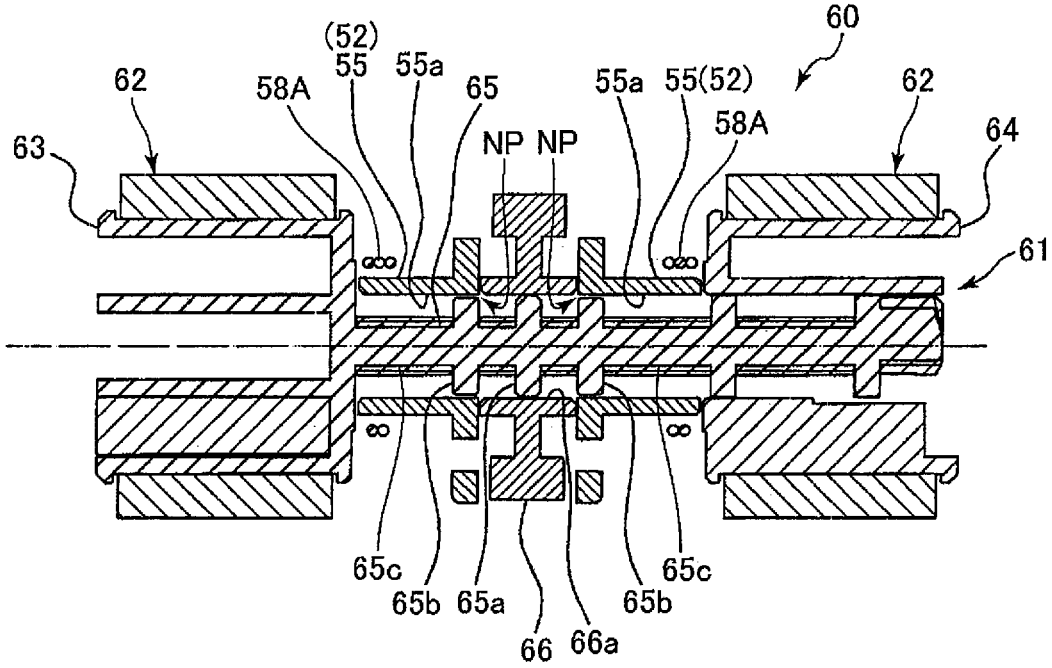
FIG. 7A is a cross-sectional view taken along a line VII-VII in FIG. 5, where a shaft part (rotational shaft) is in a reference state.
Figure 7B:
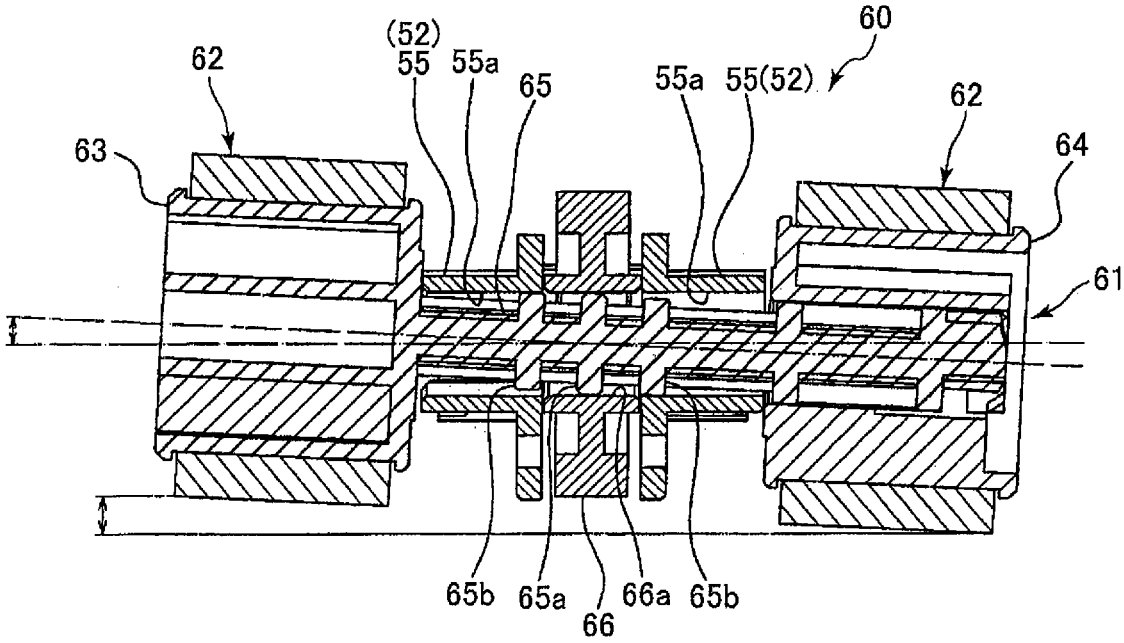
FIG. 7B is a cross-sectional view taken along the line VII-VII in FIG. 5, where the shaft part (rotational shaft) is inclined at a maximum angle from the reference state shown in FIG. 7A (maximum inclined state)
Figure 8:
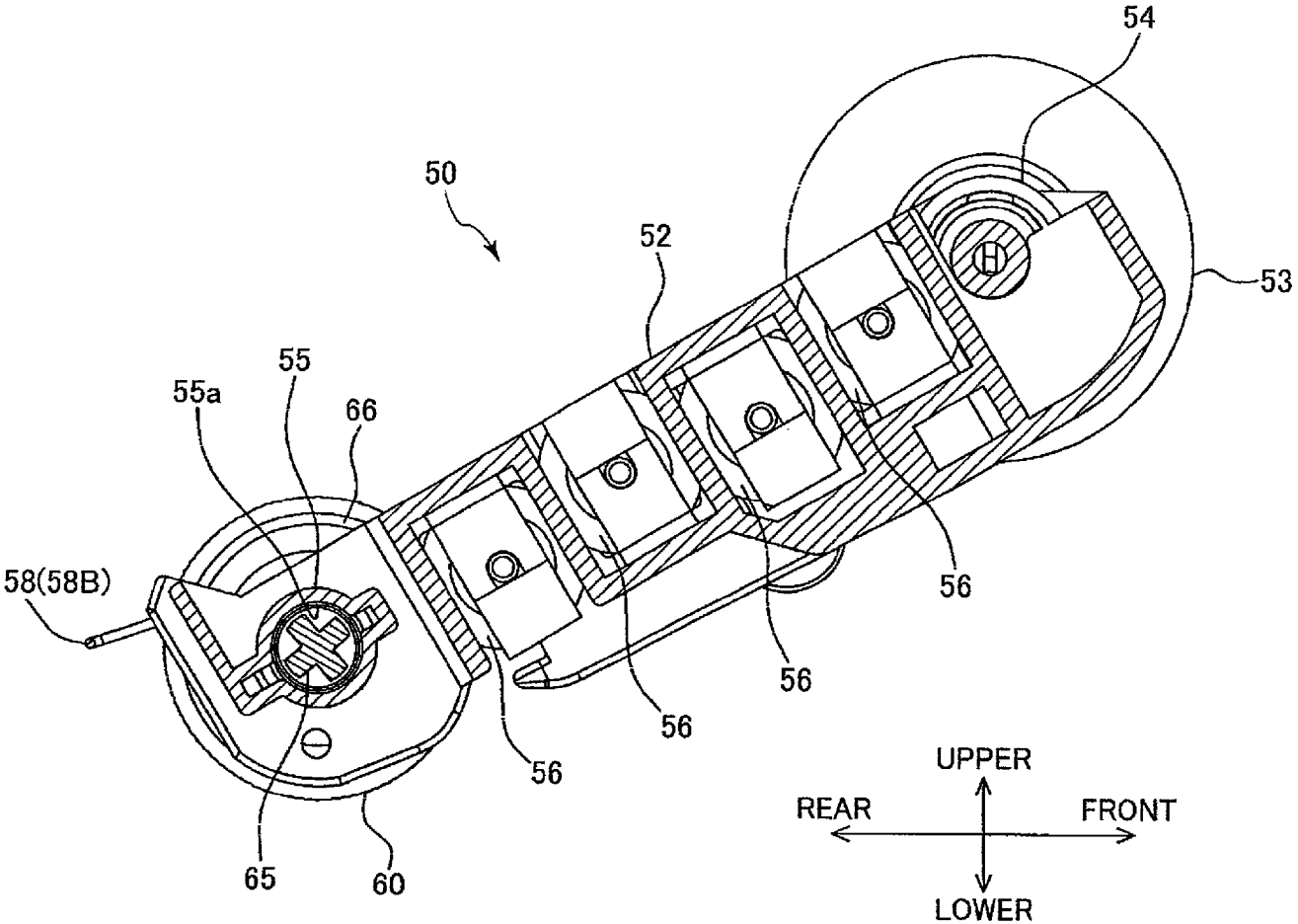
FIG. 8 is a cross-sectional view taken along a line VIII-VIII in FIG. 5.

As shown in FIGS. 7A and 7B, the feeding roller 60 has a resin main body member 61 and two rubber roller members 62 and 62 fixed at right and left ends of the main body member 61. The roller members 62 and 62 are fixed on the outer circumference of cylindrical roller supporting parts 63 and 64, respectively. The roller supporting parts 63 and 64 are formed at the both ends of the main body member 61. A bar-like shaft part 65 connecting the right and left roller supporting parts 63 and 64 to each other is formed at the center in the rotational axis direction. As shown in FIG. 8, the shaft part 65 is formed to have a cross-shaped cross section (cross-shaped cross section parts 65*c* in FIG. 7A), except for a gear contact part 65*a* formed at the center of the shaft part 65 in the axial direction and arm contact parts 65*b* and 65*b* formed on the both sides of the gear contact part 65*a* in the rotational axis direction. On the other hand, as shown in FIGS. 6A and 6B, the gear contact part 65*a* is configured to have a cross section formed of: a circle having a size containing the cross-shaped cross section (i.e., a circle having a diameter larger than a height and width of the cross-shape); and a pair of protrusions 65*p* formed at opposing positions on the outer circumference of the circle. Each of the arm contact parts 65*b* and 65*b* has a cross section of a circle having a size containing the cross-shaped cross section (i.e., a circle having a diameter larger than a height and width of the cross-shape).

In the feeding roller 60, the shaft part 65 of the main body member 61 is rotatably supported at the free end (rear end) of the arm member 52. Specifically, as shown in FIGS. 7A and 7B, two axial support parts 55 are provided at the free end of the arm member 52 along the left-right direction, so as to sandwich a drive gear 66 that transmits a rotational driving force to the feeding roller 60. Each of the two axial support parts 55 is formed with a through-hole 55*a* having a circular cross section.

The feeding roller 60 is rotatably supported in a state where the shaft part 65 of the main body member 61 is inserted into the through-hole 55*a* of each axial support part 55. In this state, each arm contact part 65*b* of the shaft part 65 is located in confrontation with the end on the central side in the left-right direction in the through-hole 55*a*. That is, a narrowest part NP (FIG. 7A) of a gap between the shaft part 65 and the through-hole 55*a* is provided at the central side in the left-right, direction (the direction parallel to the rotational axis of the feeding roller 60). The feeding roller 60 is rotatably supported at the free end of the arm member 52 in the central region in the rotational axis direction. With such configuration, by suppressing degree of freedom in position (unsteadiness of the drive gear 66) in the central region of the shaft part 65 in the left-right direction, the rotational driving force from the LF motor 6 is reliably transmitted and degree of freedom in position at the both ends of the shaft part 65 in the left-right direction (degree of freedom of the rotational axis in angle) is made larger. In this manner, the arm member 52 supports the feeding roller 60 such that an angle of the rotational axis has certain flexibility. Specifically, FIG. 7A shows a state where the shaft part. 65 (rotational shaft) is in a reference state. FIG. 7B shows a state where the shaft part 65 (rotational shaft) is inclined at a maximum angle of 3 degrees, for example, from the reference state (maximum inclined state).

In the feeding roller 60, the shaft part 65 of the main body member 61 is inserted into a through-hole 66*a* formed on the drive gear 66. As shown in FIGS. 6A and 6B, the through-hole 66*a* is formed of a circular portion corresponding to the circular portion of the gear contact part 65*a* of the shaft part 65 and a pair of fan-shaped notched parts formed at opposing positions on the outer circumference of the circular portion. Here, the fan-shaped notched parts of the through-hole 66*a* are formed so that the length in the circumferential direction is larger than that of the protrusions 65*p* of the gear contact part 65*a*. In this manner, a predetermined play in the rotational direction (for example, the angle of 60 degrees) is given to the feeding roller 60 with respect to the drive gear 66.

As shown in FIGS. 6A, 6B, and 8, four power transmission gears 56 connecting the small gear 54 fixed at the support shaft 51 to the drive gear 66 into which the shaft part 65 is inserted are serially provided in the arm member 52 along the extending direction of the arm member 52.

The arm member 52 can swing about the support shaft 51 from a downward inclined position where the rotational axis of the feeding roller 60 is lower than the support shaft 51 to a horizontal position where the rotational axis of the feeding roller 60 is located at an approximately same level as an axial center of the support shaft 51.

As shown in FIGS. 3 and 4, a first torsion coil spring 57 is provided at a base end (on a swing-axis-side end) of the arm member 52. The first torsion coil spring 57 is configured of a single wire (or other materials) having a coiled part 57A and a straight part 57B. The coiled part 57A is wound around the swing-axis-side end of the arm member 52. The straight part 57B has an end that is bent at a substantially right angle and that is in contact with a bottom surface of the sheet feeding tray 30. With this configuration, the first torsion coil spring 57 urges the arm member 52 downward (in a direction for bringing the feeding roller 60 into contact with the recording medium accommodated in the sheet feeding tray 30) in an entire swinging range. Thus, the feeding roller 60 is disposed so as to be in contact with the uppermost recording medium accommodated in the sheet feeding tray 30 (refer to FIG. 10A).

As shown in FIGS. 3, 5, and 8, a second torsion coil spring 58 is provided at the free end of the arm member 52. The second torsion coil spring 58 is configured of a single wire (or other materials) having two coiled parts 58A and a squared U shape part 58B. The coiled parts 58A are wound around the axial support parts 55 of the arm member 52 (FIG. 7A). The squared U shape part 58B is provided between the two coiled parts 58A and is bent at two positions at substantially right angles. The squared U shape part 58B is contactable with a contact piece 4*a* (restricting member) described below. With this configuration, the second torsion coil spring 58 urges the arm member 52 downward (in a direction for increasing an urging force of the first torsion coil spring 57) only in a state where the arm member 52 is located close to the horizontal position. In other words, the second torsion coil spring 58 urges the arm member 52 downward only when an angle between a plane of the recording medium and a plane containing the rotational axis of the feeding roller 60 and the swing axis of the arm member 52 is smaller than a predetermined angle.

Figure 10A:
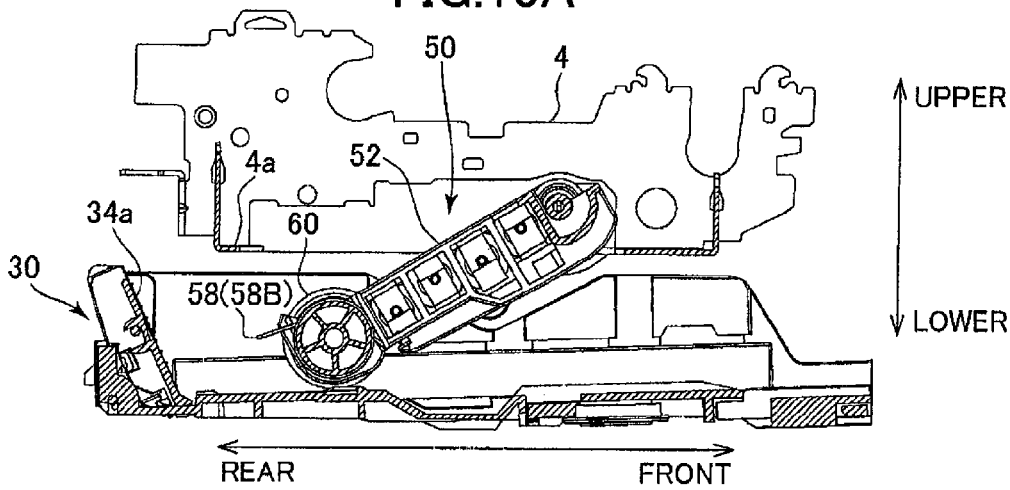
FIG. 10A is a cross-sectional view taken along a line X-X in FIG. 9, where an arm member is positioned on a bottom surface of the sheet feeding tray.
Figure 10B:
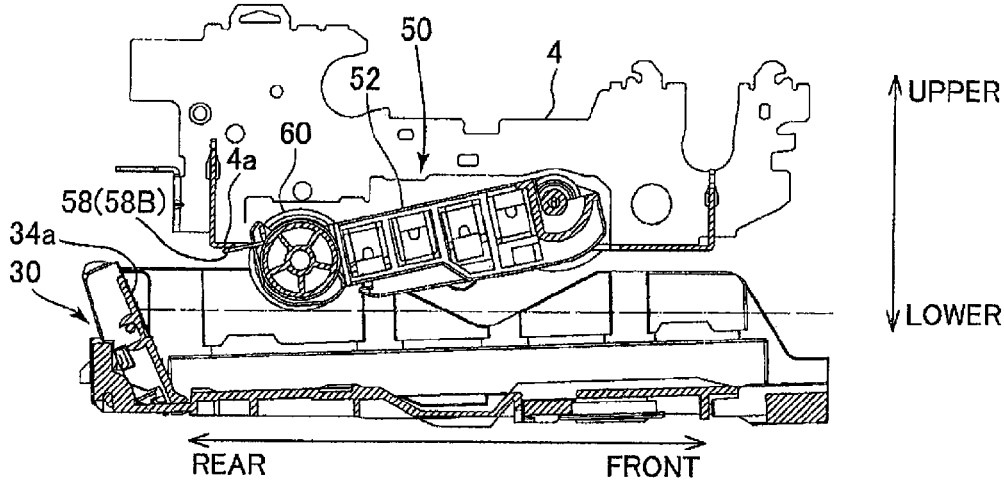
FIG. 10B is a cross-sectional view taken along the line X-X in FIG. 9, where the arm member is positioned on a bottom surface of a second tray.
Figure 10C:
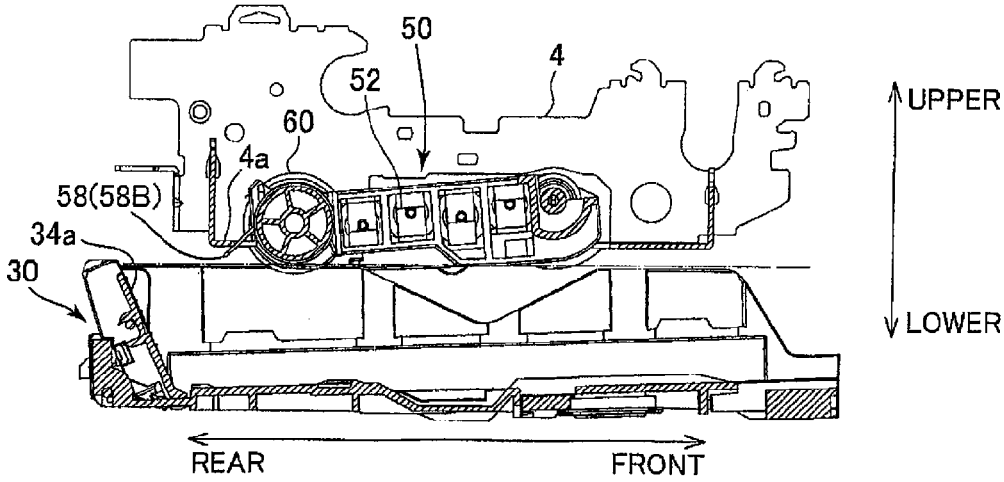
FIG. 10C is a cross-sectional view taken along the line X-X in FIG. 9, where the arm member is positioned on an uppermost recording medium when recording mediums are accommodated in the second tray to full capacity.
Figure 11:
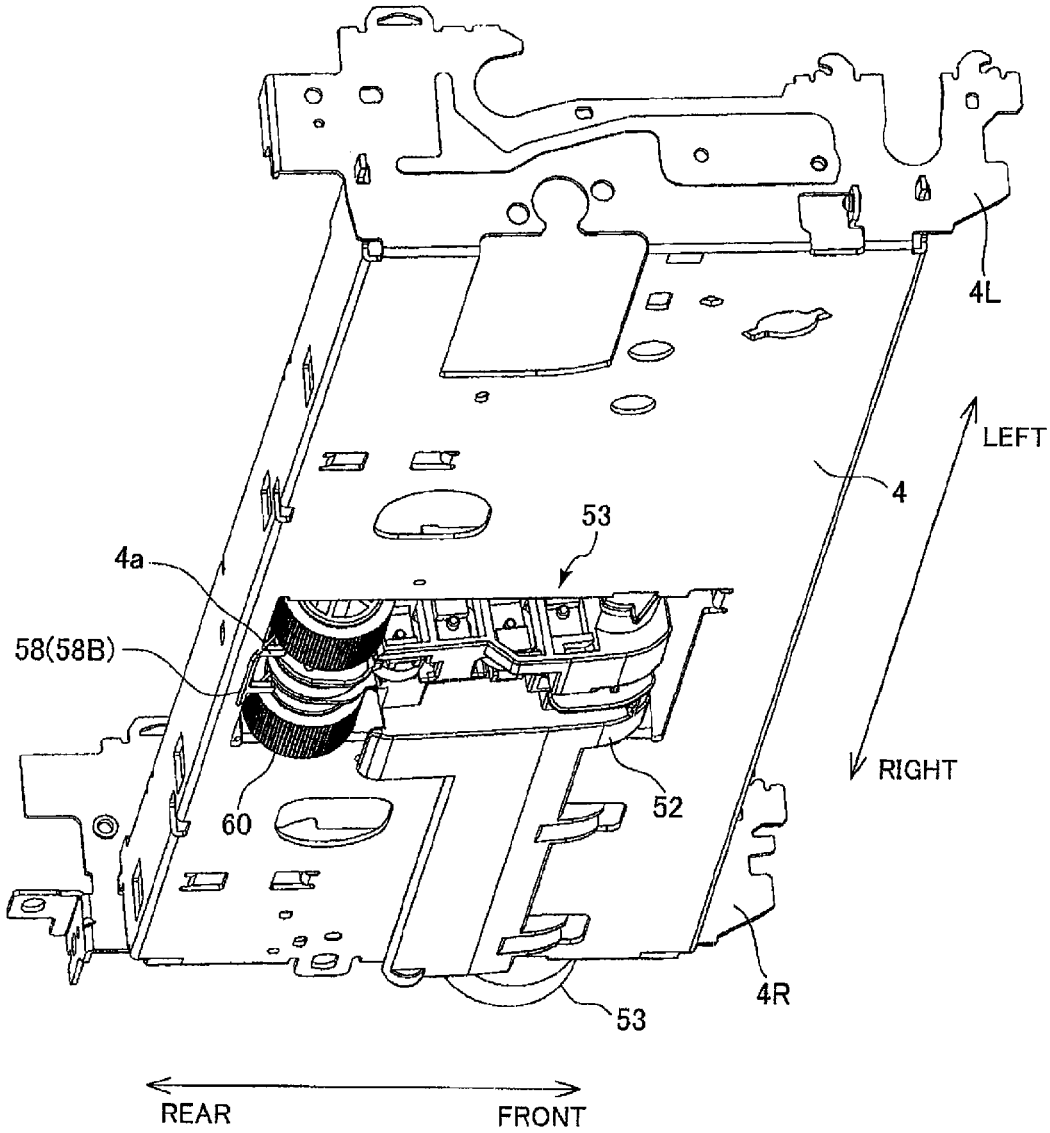
FIG. 11 is a perspective view of a configuration shown in FIG. 10C, when viewed from obliquely below the frame.

More specifically, as shown in FIGS. 10A through 10C, the frame 4 has the contact piece 4*a* provided in a swinging range of the arm member 52. The second torsion coil spring 58 urges the arm member 52 by contacting the contact piece 4*a* and by being elastically deformed. As shown in FIGS. 10B, 10C, and 11, when the arm member 52 is located so that the feeding roller 60 contacts the recording medium accommodated in the second tray 40, the free part 58B of the second torsion coil spring 58 comes into contact with the contact piece 4*a*, thereby urging the arm member 52 downward. Note that a single-dot chain line in FIG. 10B represents the position of a bottom surface of the second tray 40 (in other words, the level of the recording medium when only one recording medium is placed in the second tray 40). A single-dot chain line in FIG. 10C represents the level of the uppermost recording medium when the recording mediums are accommodated in the second tray 40 to maximum capacity.

[1-3. Configuration of Image Recording Unit]

Next, configuration of the image recording unit 70 will be described.

As shown in FIGS. 2, 12, 13A, and 13B, the image recording unit 70 has a conveying roller 71 supported by the side plate of the flame 4 so as to be rotatable about the rotational axis along the left-right direction at a position on the conveying path 5 where a recording medium is conveyed from the sheet feeding tray 30 in a U-turn manner. The image recording unit 70 also has a follow roller 72 which is provided below the conveying roller 71 so as to be rotatable about the rotational axis parallel to the conveying roller 71 and rotates following the conveying roller 71 (that is, the conveying roller 71 and the follow roller 72 form a pair of rollers).

Figure 13A:
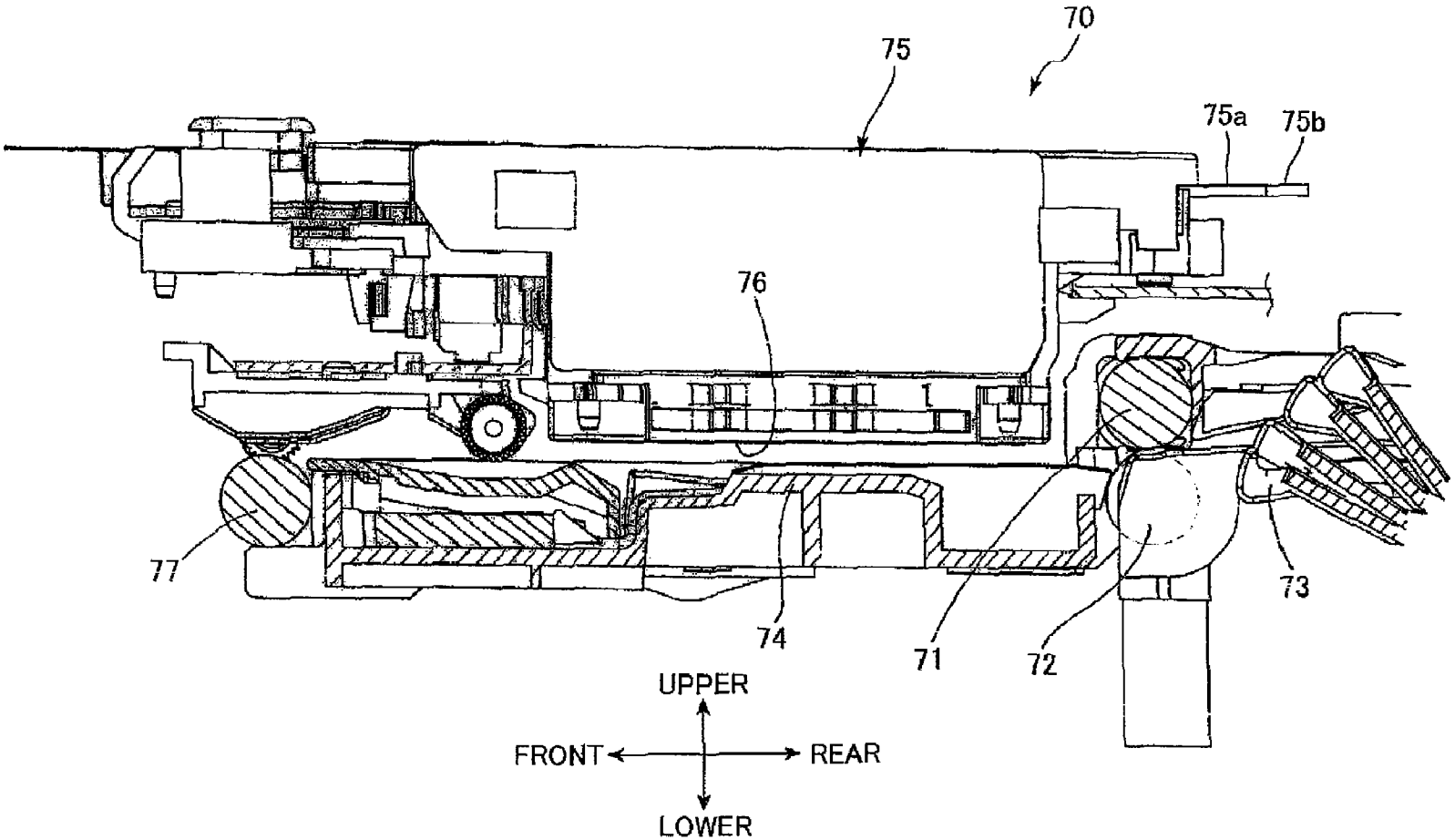
FIG. 13A is a side cross-sectional view of the image recording unit.
Figure 13B:
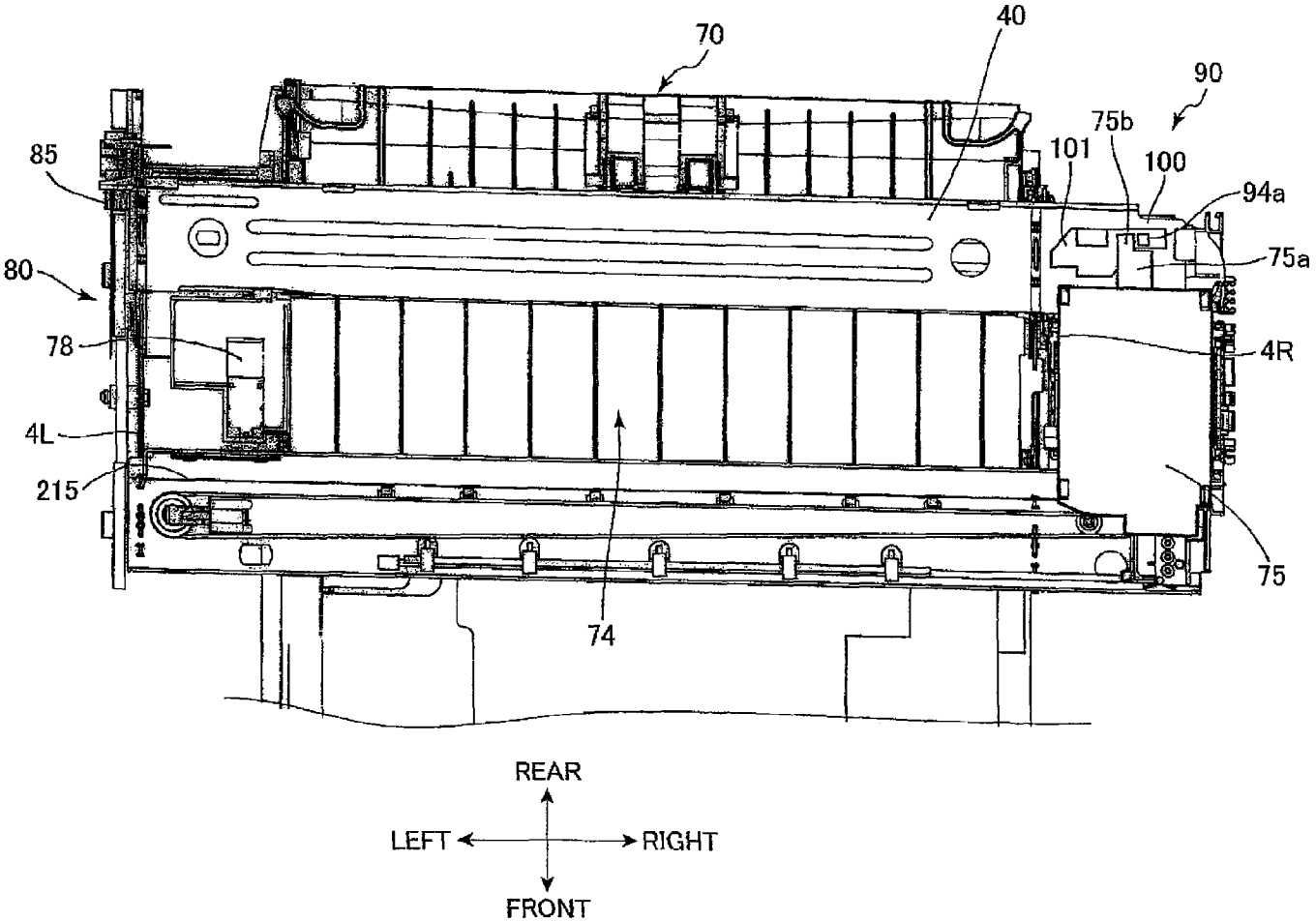
FIG. 13B is a plan view of the image recording unit with the platen and the carriage.

As shown in FIGS. 13A and 13B, a registration sensor 73 which can detect position of a leading edge and a trailing edge of a recording medium conveyed from the sheet feeding tray 30 is provided in the rear of the conveying roller 71 (on the upstream side in the conveying direction of the recording medium).

On the other hand, the image recording unit 70 has a platen 74 which supports the recording medium from below and a carriage 75 which can move above the platen 74 in the left-right direction (main scanning direction). A recording head 76 capable of ejecting ink of a plurality of colors for recording a color image is mounted on the carriage 75. The image is recorded by ejecting ink to the recording medium on the platen 74 from the recording head 76 while moving the carriage 75 in the main scanning direction. The image recording unit 70 has a discharge roller 77 supported by side plates 4L and 4R of the frame 4 (FIG. 12) so as to be rotatable about the rotational axis along the left-right direction in front of the platen 74 (on the downstream side in the conveying direction of the recording medium).

Figure 12:
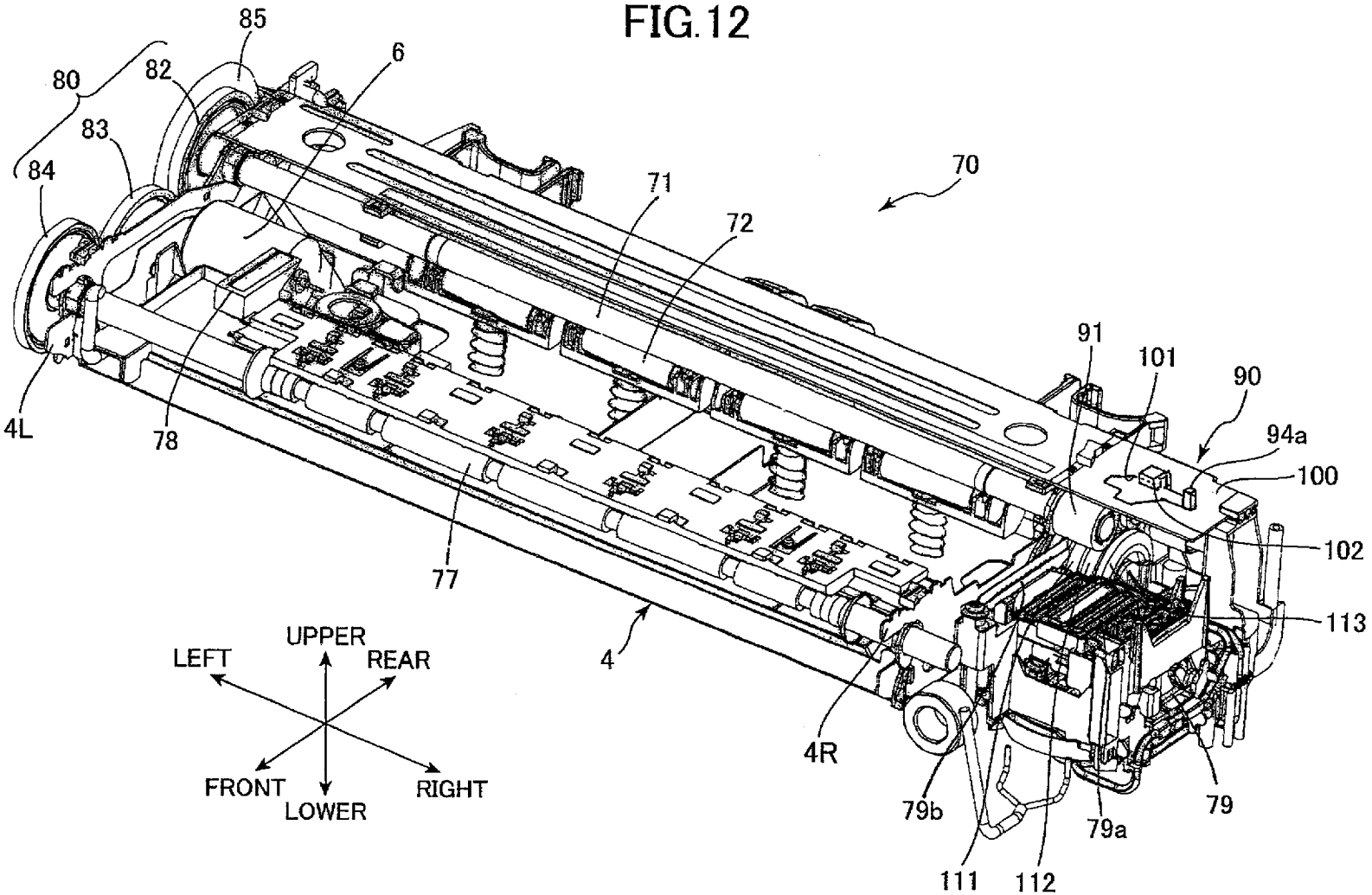
FIG. 12 is a perspective view of an image recording unit of the image forming apparatus without a platen and a carriage.

As shown in FIG. 12, in the image recording unit 70, an ink receiving part 78 and a maintenance section 79 are provided on the left side and the right side, respectively, outside of the conveyed recording medium in the left-right direction (width direction). The recording head 76 regularly ejects ink for preventing clogging of a nozzle at a flushing position on the ink receiving part 78 during the recording operation.

[2. Description of Driving System]

Next, a driving system of the image forming apparatus 1 in the illustrative aspects will be described.

Figure 14:
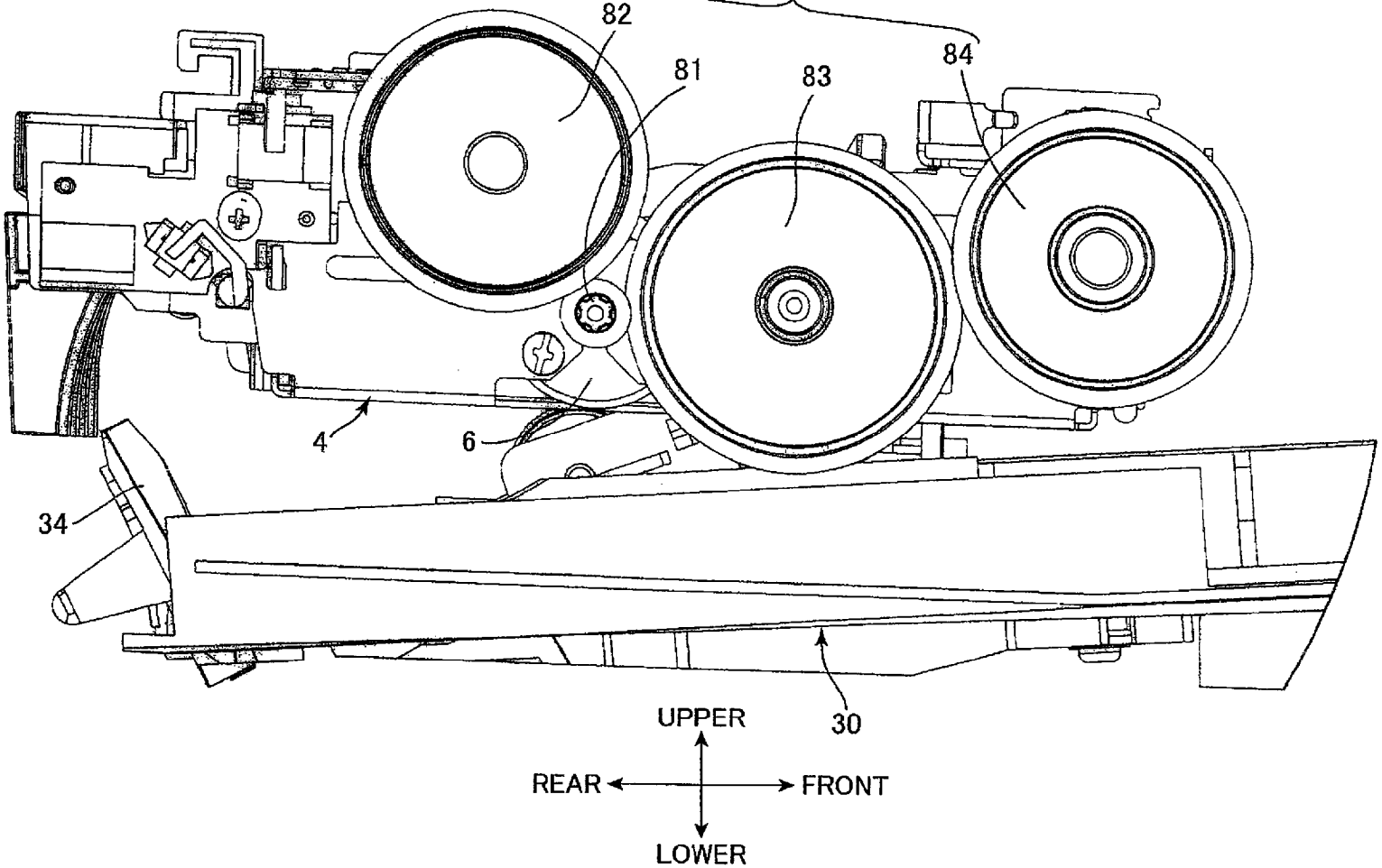
FIG. 14 is a side view of the image recording unit.
Figure 24:
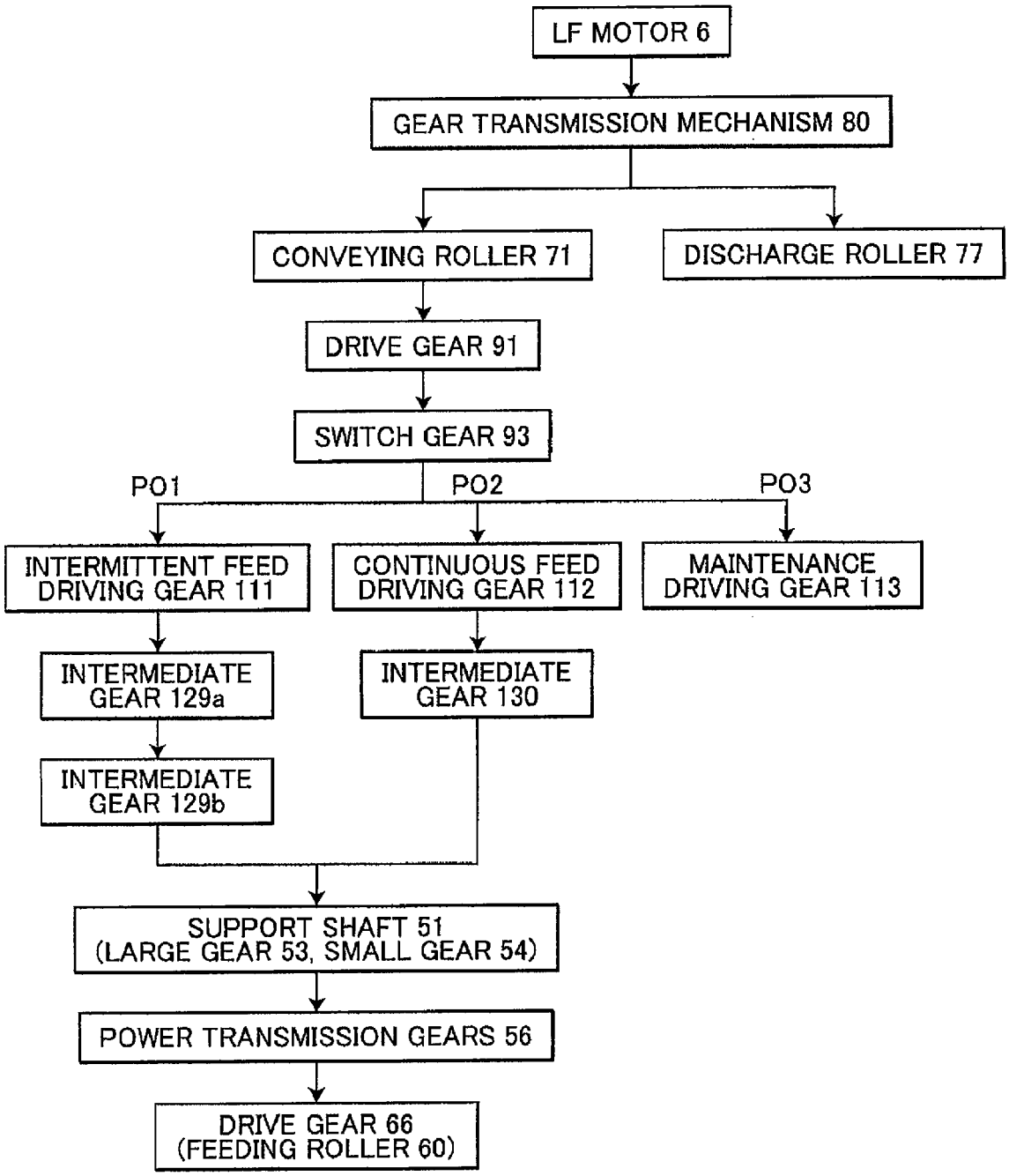
FIG. 24 is a block diagram showing the transmission route of the rotational driving force from an LF motor to the feeding roller.

As shown in FIG. 12 and FIG. 14, the image forming apparatus 1 has the LF motor 6 capable of generating the rotational driving force both in the forward and reverse directions. As shown in FIG. 24, the rotational driving force generated by the LF motor 6 is transmitted to the conveying roller 71 and the discharge roller 77 through a gear transmission mechanism 80.

Specifically, the gear transmission mechanism 80 includes a pinion 81 fixed to a driving shaft of the LF motor 6, a driving gear 82, and an intermediate gear 83 which engage with the right and left sides of the pinion 81, respectively, and a driving gear 84 engaging with the intermediate gear 83. As shown in FIG. 12, the driving gear 82 is fixed at the left end of the conveying roller 71, and the driving gear 84 is fixed at the left end of the discharge roller 77. A rotary encoder 85 fox detecting a conveyed distance of a recording medium is provided at a part of the gear transmission mechanism 80.

Figure 15A:
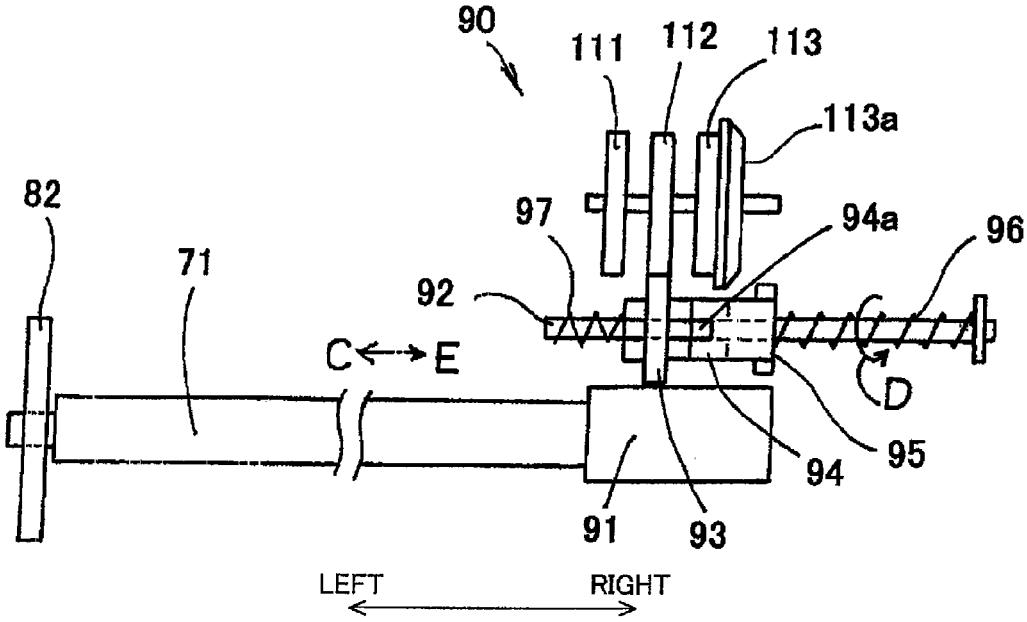
FIG. 15A is a schematic view of a power transmission switch mechanism when viewed from above.

As shown in FIG. 15A, the rotational driving force generated by the LF motor 6 is selectively transmitted to the feeding roller 60 and a maintenance mechanism (not shown in detail) from the left end of the conveying roller 71 via a power transmission switch mechanism 90 disposed above the maintenance section 79.

In other words, the power transmission switch mechanism 90 is configured so as to switch the transmission state of the rotational driving force transmitted from the LF motor 6 through the conveying roller 71 between: a maintenance-mode transmission state for transmitting the rotational driving force to only the maintenance section 79; and a conveying transmission state for transmitting the rotational driving force to only the feeding roller 60 of the sheet feeding unit 50. The conveying transmission state is configured so as to switch between: an intermittent-feed-mode transmission state for transmitting the rotational driving force so as to rotate one of the conveying roller 71 and the feeding roller 60 in the forward direction and the other roller in the reverse direction (the direction opposite to the forward direction) and a continuous-feed-mode transmission state for transmitting the rotational driving force so as to rotate both the conveying roller 71 and the feeding roller 60 in the forward direction. The image forming apparatus 1 is configured so that a conveying speed of a recording medium by the conveying roller 71 is higher than a conveying speed of the recording medium by the feeding roller 60. The forward direction of the rollers 60, 71, and 77 is a rotational direction for conveying a recording medium from the supply side to the discharge side. Specifically, the forward direction of the feeding roller 60 and the conveying roller 71 is a rotational direction for conveying the recording medium to an image forming position at which the image recording unit 70 forms an image. The forward direction of the discharge roller 77 is a rotational direction for conveying the recording medium from the image forming position to the discharge position.

Specific configuration of the power transmission switch mechanism 90 will be described below.

Figure 15B:
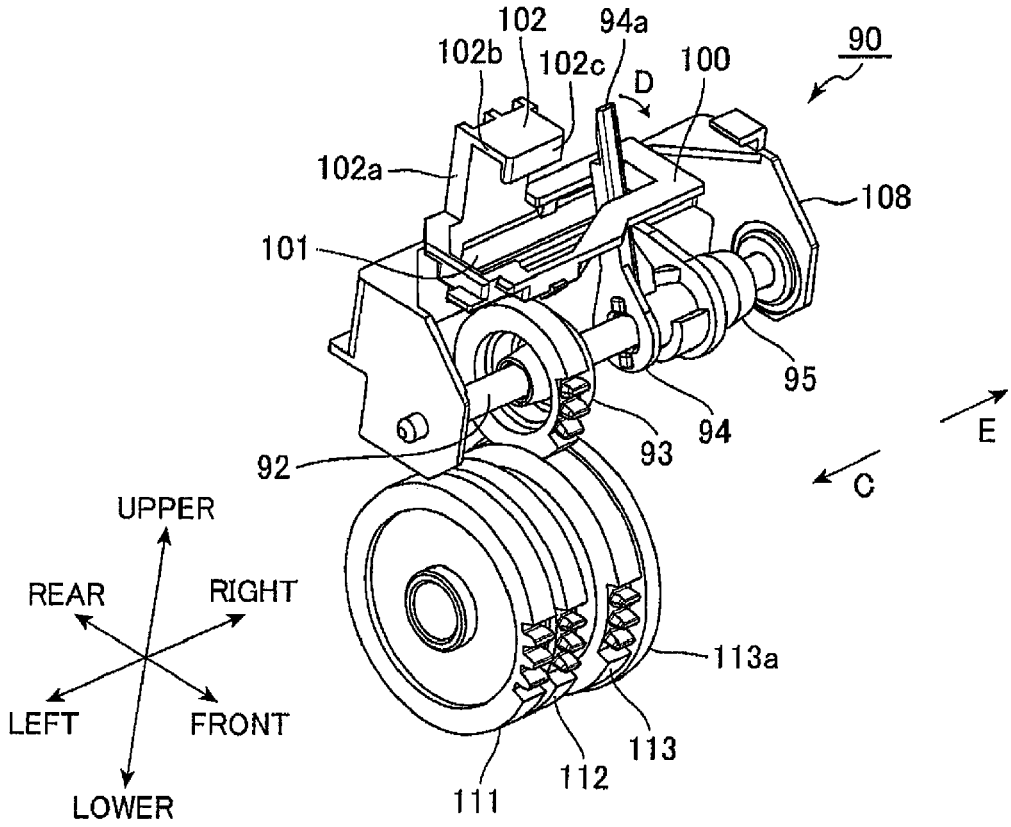
FIG. 15B is a perspective view of the power transmission switch mechanism.
Figure 15C:
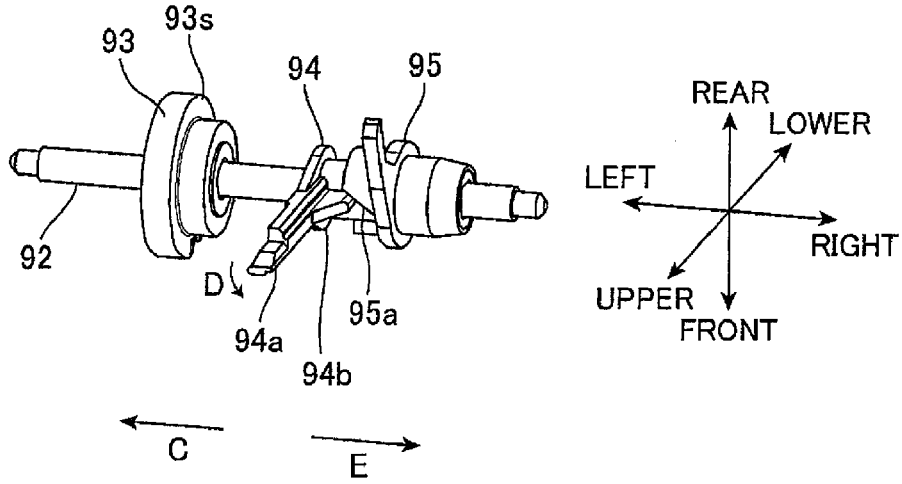
FIG. 15C shows how a switch gear, a first block, and a second block are arranged on a sliding shaft in the power transmission switch mechanism of FIG. 15B.

As shown in FIGS. 15A through 15C, the power transmission switch mechanism 90 has a drive gear 91 which extends in the axial direction and is fixed at the right end of the conveying roller 71 and a switch gear 93 which can slide along a sliding shaft 92 disposed in parallel to the rotational axis of the conveying roller 71 and is constantly engaged with the drive gear 91. Although teeth are shown only on a part of the periphery of the switch gear 93 in FIG. 15B and FIG. 15C, teeth are formed on the entire periphery of the switch gear 93.

The power transmission switch mechanism 90 have a first block 94 which is slidably and rotatably provided with respect to the sliding shaft 92 and includes a contact piece 94*a* extending upward and a second block 95 which is slidably provided with respect to the sliding shaft 92 and disposed adjacent to the first block 94. The first block 94 can be separated from the switch gear 93.

The power transmission switch mechanism 90 has a first urging spring 96 which is fitted to the sliding shaft 92 and urges the second block 95 in the direction of an arrow C in FIG. 15A and a second urging spring 97 which is fitted to the sliding shaft 92 and urges the switch gear 93 in the direction of an arrow E in FIG. 15A. In addition, the power transmission switch mechanism 90 has an intermittent feed driving gear 111, a continuous feed driving gear 112, and a maintenance driving gear 113 which are selectively engaged with the switch gear 93 depending on a sliding position of the switch gear 93. Although teeth are shown only on a part of the entire periphery of each gear 111, 112, and 113 in FIG. 15B, teeth are formed on the entire periphery of each gear 111, 112, and 113.

As shown in FIGS. 13A and 13B, a first engaging stepped part 75*a* protrudes rearwardly from the rear surface of the carriage 75. A second engaging stepped part 75*b* protrudes rearwardly from the rear surface of the first engaging stepped part 75*a* When the carriage 75 is positioned on the right-side end of the image forming apparatus 1 and above the maintenance section 79 as shown in FIG. 13B, the first and second engaging stepped parts 75*a* and 75*b* are located above a plate-shaped guide block 100 of the power transmission switch mechanism 90.

Figure 16A:
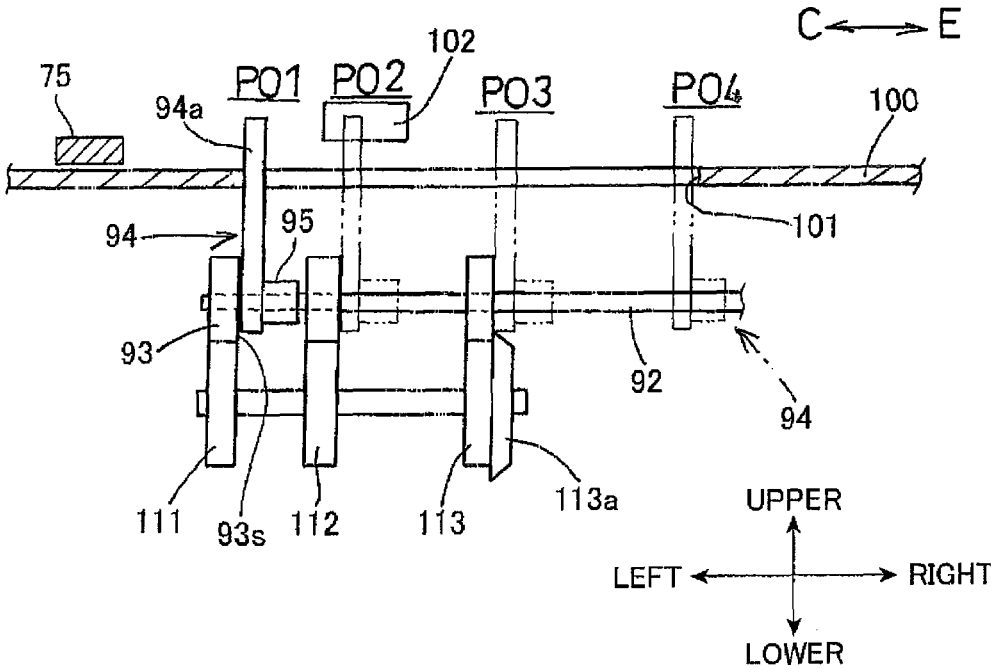
FIG. 16A is a front view showing the power transmission switch mechanism switched to each mode.
Figure 16B:
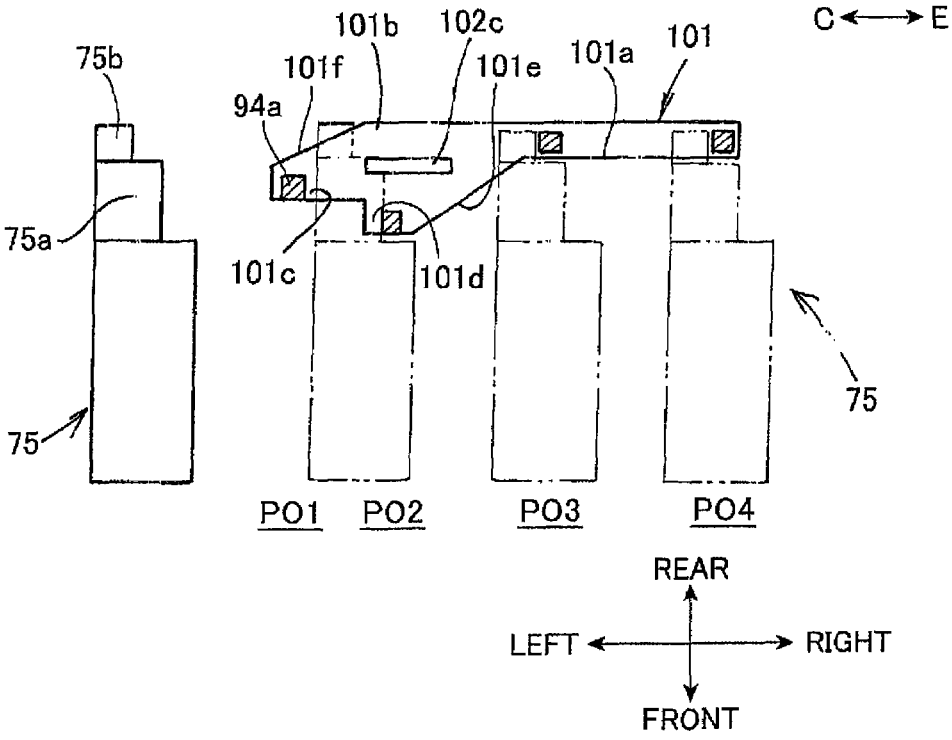
FIG. 16B is a plan view showing the power transmission switch mechanism switched to each mode.

With this configuration, when the carriage 75 is positioned on the right-side end of the image forming apparatus 1 and above the maintenance section 79, as shown in FIG. 16B, the carriage 75 receives, on either the first engaging stepped part 75*a* or the second engaging stepped part 75*b*, the contact piece 94*a* of the first block 94 that protrudes upwardly through the guide through-hole 101 of the plate-shaped guiding block 100. Thus, as the carriage 75 moves in the left-to-right direction, the contact piece 94*a* slides within the guide through-hole 101 in the leftward direction or in the rightward direction. As a result, the first block 94, the switch gear 93, and the second block 95 slide over the sliding shaft 92 in the leftward direction or in the rightward direction as the carriage 75 moves in the leftward direction or in the rightward direction (the direction of the arrow C or the arrow E). As shown in FIG. 15C, an endface cam part 94*b* and an endface cam part 95*a* are formed on the opposing surfaces of the first block 94 and second block 95, respectively. The endface cam part 95*a* is slanted relative to the axis of the sliding shaft 92. With this configuration, when the second block 95 presses the first block 94 in the leftward direction C, the first block 94 with the contact piece 94*a* rotates in a frontward direction D indicated in FIGS. 15B and 15C.

As shown in FIGS. 15B, 16A, and 16B, the plate-shaped guide block 100 is provided above the first block 94. A guide through-hole 101 is formed in the guide block 100. A distal end of the contact piece 94*a* is vertically inserted in the guide through-hole 101 and is slidable in the left-right direction in the guide through-hole 101. As shown in FIG. 16A (plan view), the guide through-hole 101 has a straight groove part 101*a* which extends in the direction of the arrow C, E and a wide groove part. 101*b* communicating with the left end of the straight groove part 101*a*.

As shown in FIG. 15B, the guide block 100 has a restricting piece 102. The restricting piece 102 has: a rising part 102*a* rising up from the rear edge of the guide block 100 on the rear side of the wide groove part 101*b*; a forwardly-extending part 102*b* extending forwardly from the top end of the rising part 102*a* toward the position above the center region of the wide groove part 101*b*; and a downwardly-extending part 102*c* extending downwardly from the front edge of the forwardly-extending part 102*b*. The downwardly-protruding part 102*c* extends downward as opposing the center region of the wide groove part 101*b* (FIG. 16B). As shown in FIG. 16B, the rear surface of the downwardly-extending part 102*c* is in line with the front side edge of the straight groove part 101*a*.

A step-like first setting part 101*c* and a step-like second setting part 101*d* are provided on the front part of the wide groove part 101*b*. The guide block 100 has a front-right-side sloped edge 101*e* on the front-right side edge of the wide groove part 101*b* in continuation with the front edge of the straight, groove part 101*a*, and a rear-left side sloped edge 101*f* on the rear-left side edge of the wide groove part 101*b*.

Thus, as shown in FIG. 16A, when the carriage 75 largely moves from the maintenance section 79 (FIG. 12) leftward (in the direction of the arrow C) and is located in a recording area of a recording medium, the second block 95 is pushed leftward by the first urging spring 96, thereby pressing the first block 94 and the switch gear 93 to move along the sliding shaft 92. At, this time, the contact piece 94*a* of the first block 94 is located at the first setting part 101*c* (hereinafter, this position is referred to as a "first position PO1". At this position, the switch gear 93 engages with the intermittent feed driving gear 111.

When the carriage 75 moves from the first position PO1 rightward (in the direction of the arrow E), the contact piece 94*a* is pushed by the first engaging stepped part 75*a* of the carriage 75 and arrives at the second setting part 101*d* (hereinafter, this position is referred to as a "second position PO2". In this state, the switch gear 93 engages with the continuous feed driving gear 112.

When the carriage 75 further moves from the second position PO2 rightward (in the direction of the arrow E), the contact piece 94*a* is pushed by the first engaging stepped part 75*a* and slides along the front-right-side sloped edge 101*e*. Then, the contact piece 94*a* arrives at a left-end position (an entrance position) of the straight groove part 101*a* (hereinafter, the position is referred to as a "third position PO3". In this state, the contact piece 94*a* is in contact with the second engaging stepped part 75*b* of the carriage 75.

When the carriage 75 further moves from the third position PO3 rightward (in the direction of the arrow E), the contact piece 94*a* is pushed by the second engaging stepped part 75*b* of the carriage 75 and is located at the right end of the straight groove part 101*a* (hereinafter, the position is referred to as a "fourth position PO4". The fourth position PO4 serves as a home position (starting position). At this time, a side surface 93*s* of the switch gear 93 comes into contact with a bevel gear part 113*a* of the maintenance driving gear 113, thereby preventing the switch gear 93 from moving rightward (in the direction of the arrow E). As a result, the switch gear 93 is separated from the first block 94 and keeps its engaged state with the maintenance driving gear 113.

On the contrary, when the carriage 75 moves from the fourth position PO4 leftward (in the direction of the arrow C) and the contact piece 94*a* moves from the straight groove part 101*a* to the wide groove part 101*b*, since the contact piece 94*a* is received by the first engaging stepped part 75*a*, the contact piece 94*a* does not enter to the front-right-side sloped edge 101*e*. Thus, the contact piece 94*a* slides along the downwardly-extending part 102*c* and then moves along the rear-left side sloped edge 101*f* of the wide groove part 101*b*. In this way, the contact piece 94*a* arrives at the first setting part 101*c*.

Among the above-described four positions PO1-PO4, the third position PO3 is a maintenance position also serving as a waiting position. At this position, as shown in FIG. 12, a cap part 79*a* of the maintenance section 79 covers a nozzle surface of the recording head 76 from below. At the time of maintenance, the LF motor 6 drives a suction pump (not shown) to perform recovery processing of selectively sucking ink from nozzles, removing air bubbles in a buffer tank (not shown) on the recording head 76 and the other similar operations When the carriage 75 moves from the maintenance section 79 to the image forming region in the leftward direction, the nozzle surface is wiped by a cleaner (wiper blade) 79*b* and ink adhered to the nozzle surface is removed When the image forming apparatus 1 is switched off, the carriage 75 stops at a position above the maintenance section 79 (the third position PO3) and the nozzle surface of the recording head 76 is covered with the cap part 79*a*.

Figure 17A:
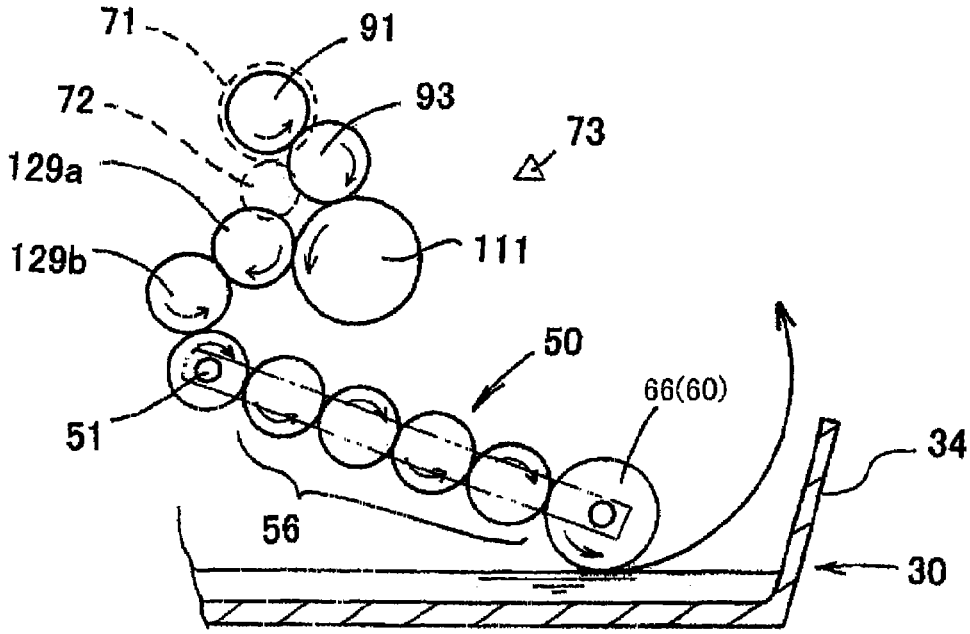
FIG. 17A is a schematic view for illustrating a transmission route of a rotational driving force in an intermittent feed mode, where an uppermost recording medium which contacts the feeding roller is separated and fed to a conveying path.
Figure 17B:
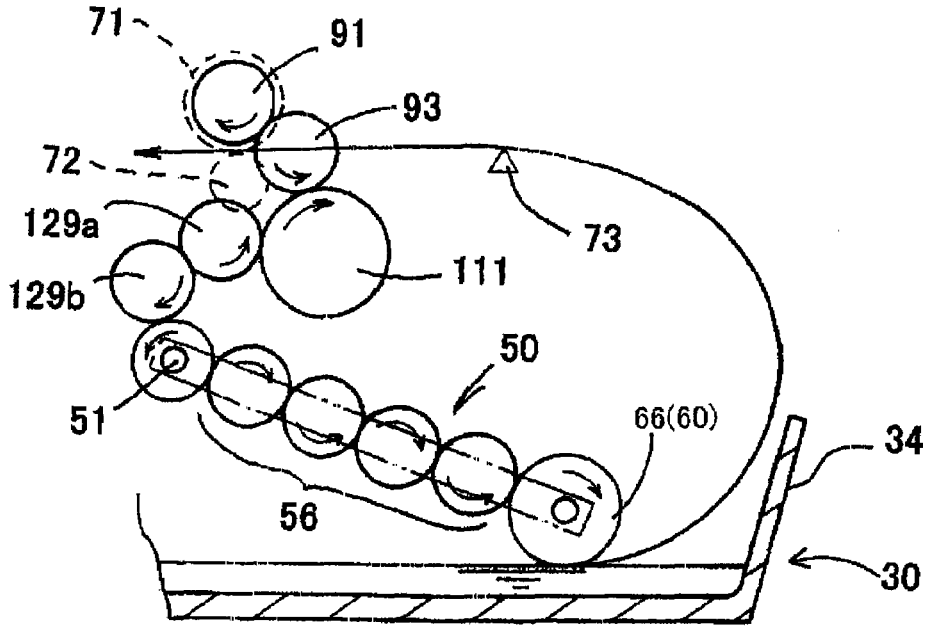
FIG. 17B is a schematic view for illustrating the transmission route of the rotational driving force in the intermittent feed mode, where the recording medium is positioned at a nip part between the conveying roller and a follow roller.
Figure 19A:
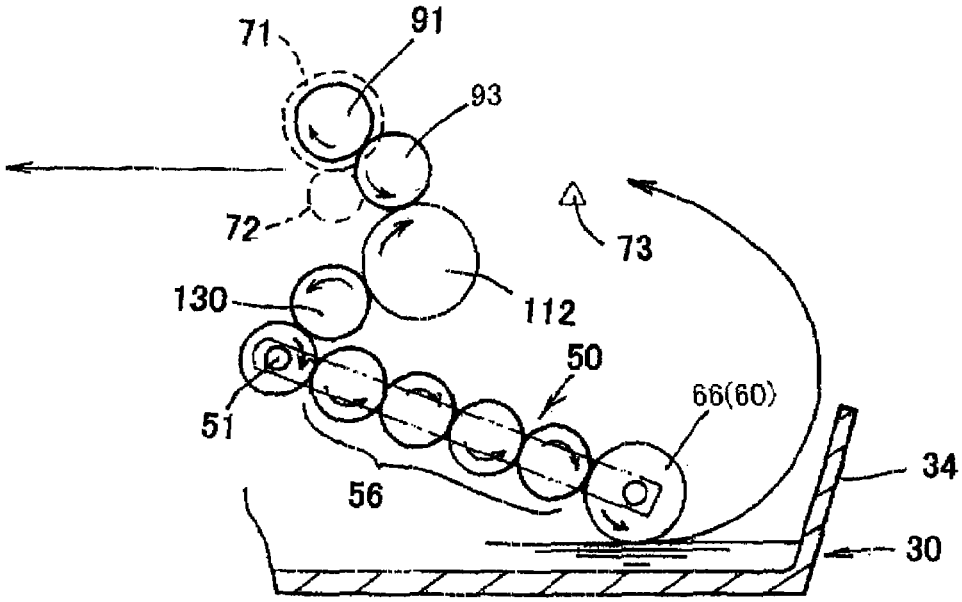
FIG. 19A is a schematic view for illustrating a transmission route of a rotational driving force in a subsequent medium process, where a leading end of a subsequent recording medium has not reached a position of a registration sensor.
Figure 19B:
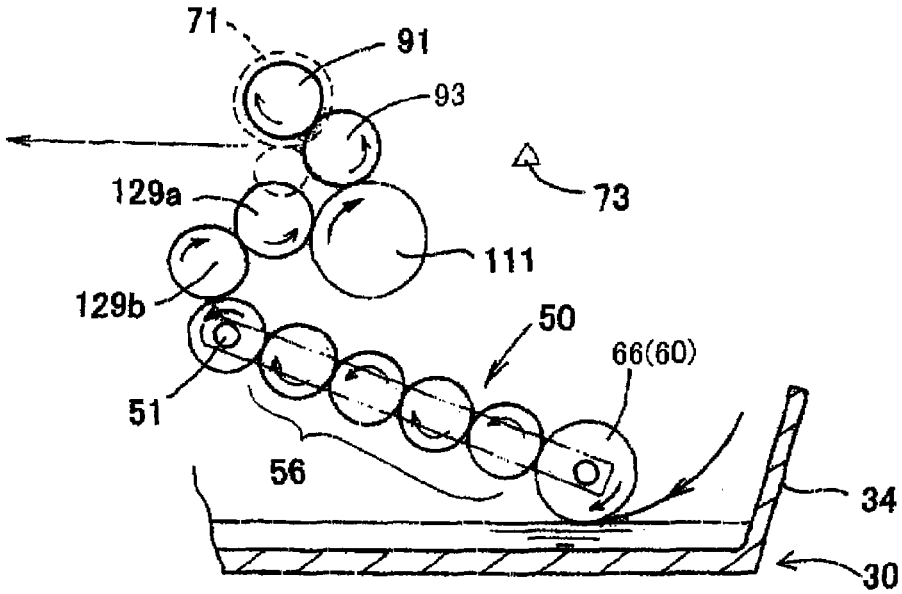
FIG. 19B is a schematic view for illustrating the transmission route of the rotational driving force in the subsequent medium process, where a recording medium subjected to slant correction is discharged and the subsequent recording medium is returned to the sheet, feeding tray.

As shown in FIGS. 17A, 17B, and 19B, when the switch gear 93 engages with the intermittent feed driving gear 111 at the first position PO1, a rotational driving force is transmitted to the support shaft 51 (FIG. 3) via two intermediate gears 129*a* and 129*b* and the rotational driving force is transmitted to the drive gear 66 via the power transmission gears 56.

On the other hand, as shown in FIGS. 18A through 18C and 19A, when the switch gear 93 engages with the continuous feed driving gear 112 at the second position PO2, a rotational driving force is transmitted to the support shaft 51 via an intermediate gear 130 and the rotational driving force is transmitted to the drive gear 66 through the power transmission gears 56.

[3. Description of Control System]

Next, a control system of the image forming apparatus 1 according to the illustrative aspects will be described.

Figure 20:
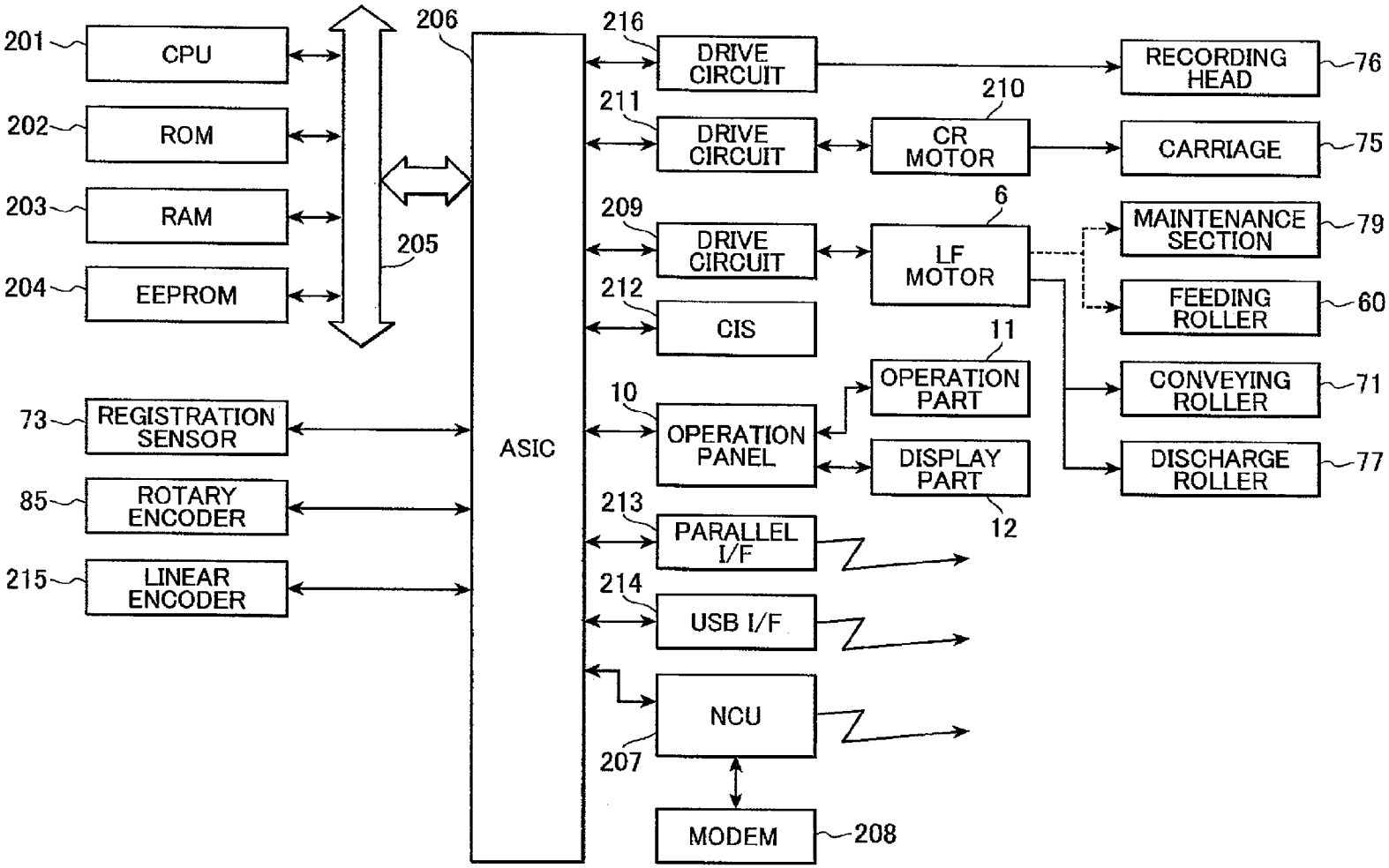
FIG. 20 is a block diagram showing a schematic configuration of a control system of the image forming apparatus.

FIG. 20 is a block diagram showing schematic configuration of the control system of the image forming apparatus 1.

As shown in FIG. 20, the image forming apparatus 1 has a CPU 201, a ROM 202, a RAM 203, and an EEPROM 204. These components are connected to an ASIC (Application Specific Integrated Circuit) 206 through a bus 205.

The ROM 202 stores a program for controlling various operations of the image forming apparatus 1 and the like. The RAM 203 is used as a storage area (operation area) where various data used when the CPU 201 executes the program is temporarily stored.

An NCU (Network Control Unit) 207 is connected to the ASIC 206. A communication signal input from a public line through the NCU 207 is demodulated by a MODEM 208 and the demodulated communication signal is input to the ASIC 206. When the ASIC 206 transmits image data to the outside by facsimile communication or a similar means, the image data is modulated to a communication signal by the MODEM 208 and the modulated communication signal is output to the public line through the NCU 207.

According to an instruction by the CPU 201, the ASIC 206 generates a phase excitation signal which applies power to the LF motor 6 and other signals, sends these signals to a driving circuit 209 of the LF motor 6 and a driving circuit 211 of a CR motor (a motor for driving the carriage 75) 210. Then, the ASIC 206 passes driving signals to the LF motor 6 and the CR motor 210 through the driving circuit 209 and the driving circuit 211, respectively, to control forward and reverse rotation and stoppage of the LF motor 6 and the CR motor 210.

A CIS (Contact Image Sensor) 212 serving as the image reading device in the scanner unit 20, the operation panel 10 having the operation part, 11 and the display part 12, and a parallel interface 213, and a USB interface 214 for transmitting/receiving data to/from an external information processing device such as a personal computer via a parallel cable and a USB cable are connected to the ASIC 206.

Furthermore, the registration sensor 73, the rotary encoder 85, and a linear encoder 215 are connected to the ASIC 206. The linear encoder 215 (also shown in FIG. 13B) detects the position of the carriage 75 in the main scanning direction.

The driving circuit 216 allows the recording head 76 to selectively eject ink to a recording medium at a predetermined timing and controls driving of the recording head 76 in response to the signal generated and outputted by the ASIC 206 on the basis of a driving control procedure outputted from the CPU 201.

Figure 21:
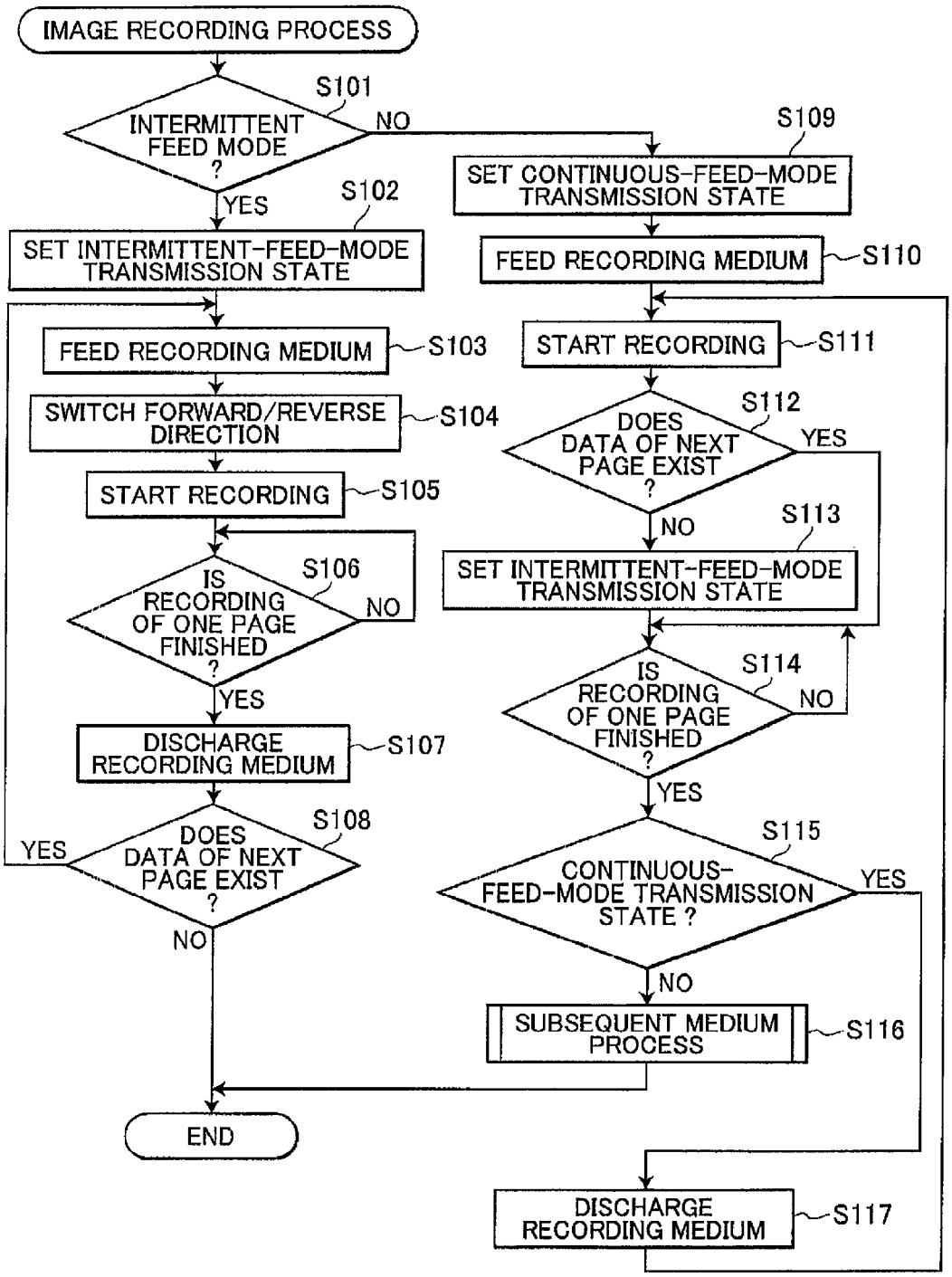
FIG. 21 is a flow chart of an image recording process.

Next, an image recording process performed by the CPU 201 will be described with reference to a flow chart of FIG. 21. The image recording process is started when an image recording instruction is inputted from an external information processing device (for example, a personal computer) Note that a transmission route for a rotational driving force from the LF motor 6 to the feeding roller 60 is shown in the block diagram of FIG. 24, and that the rotational directions (forward/reverse) of the LF motor 6, conveying roller 71, and feeding roller 60 in intermittent and continuous feed modes (described latex) is shown in the table of FIG. 25.

When the image recording process is started, in S101, the CPU 201 determines a feed mode that is currently set. In other words, the image forming apparatus 1 in the illustrative aspects is configured so that the user can select the feed mode from an intermittent feed mode and a continuous feed mode, in recording images on a plurality of recording mediums. The intermittent feed mode is a feed mode for conveying a recording medium fed from the sheet feeding tray 30 to the image recording unit 70 after slant correction by the conveying roller 71 (i.e., a feed mode that puts priority on image recording accuracy or image recording quality). The continuous feed mode is a feed mode for conveying a recording medium fed from the sheet feeding tray 30 to the image recording unit 70 without slant correction by the conveying roller 71 (i.e., a feed mode that puts priority on image recording speed).

If in S101 the CPU 201 determines that the currently-set feed mode is the intermittent feed mode, the CPU 201 proceeds to S102 and sets the power transmission switch mechanism 90 to the intermittent-feed-mode transmission state. Specifically, when the carriage 75 waiting at the waiting position (the third position PO3) is largely moved leftward to the image recording area (in the direction of the arrow C in FIG. 16A), the first block 94 being pressed by the first urging spring 96 moves along the downwardly-extending part 102*c* leftward. When the carriage 75 further moves leftward beyond the wide groove part 101*b*, the contact piece 94*a* of the first block 94 is received by the first setting part 101*c* and the position of the contact piece 94*a* (the first block 94) is maintained (the first position PO1). At the first position PO1, the switch gear 93 engages with the intermittent feed driving gear 111 and a rotational driving force is transmitted to the support shaft 51 of the sheet feeding unit 50 via the two intermediate gears 129*a* and 129*b* shown in FIG. 17A.

In S103 the recording medium is fed from the sheet feeding tray 30 to the image recording unit 70. Specifically, the CPU 201 controls the LF motor 6 to rotate in the reverse direction, thereby driving the conveying roller 71 to rotate in the reverse direction (the counterclockwise direction in FIG. 17A) and driving the feeding roller 60 to rotate in the forward direction (the counterclockwise direction in FIG. 17A). Thus, a plurality of recording mediums accommodated in the sheet feeding tray 30 hits against the guide plate 34 provided at the rear end of the sheet feeding tray 30 and only the uppermost recording medium which contacts the feeding roller 60 is separated and fed (conveyed) to the conveying path 5. At this time, since the conveying roller 71 is rotatingly driven in the reverse direction, the leading end of the recording medium hits against a nip part between the conveying roller 71 and the follow roller 72 (that is, passage of the recording medium is prevented), thereby correcting slant of the recording medium.

In S104 the CPU 201 switches the rotational direction of the rotational driving force generated by the LF motor 6. Specifically, the CPU 201 switches the rotational direction from the reverse direction to the forward direction, when the recording medium is conveyed a predetermined distance after the leading end of the recording medium is detected by the registration sensor 73 (i.e., when the leading end of the recording medium reaches the conveying roller 71). Thus, as shown in FIG. 17B, by rotatingly driving the conveying roller 71 in the forward direction (in the clockwise direction in FIG. 17B), the recording medium is positioned at the nip part between the conveying roller 71 and the follow roller 72. At this time, the feeding roller 60 is rotatingly driven in the reverse direction (in the clockwise direction in FIG. 17B).

Figure 23A:
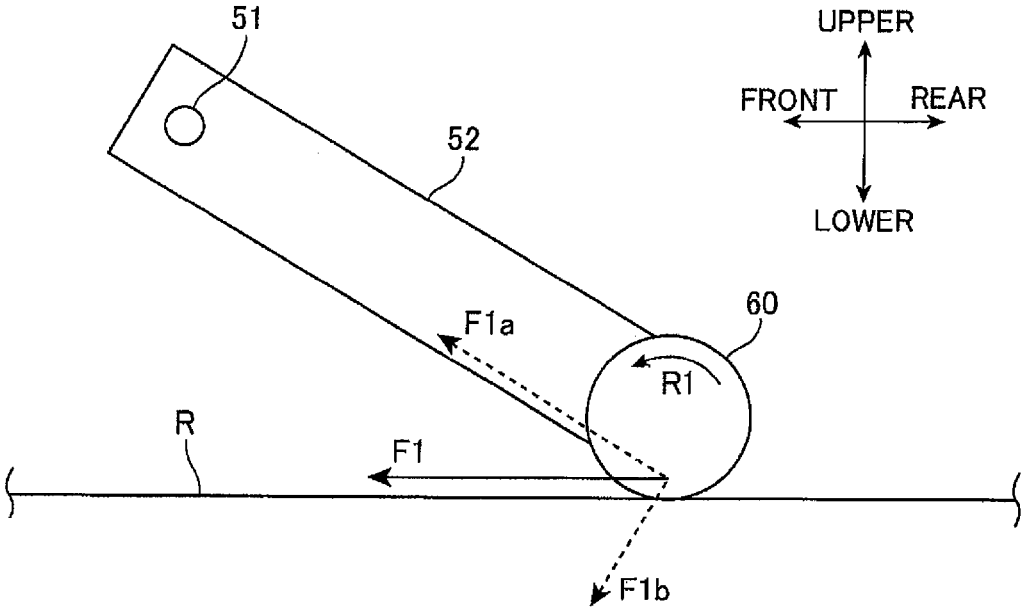
FIG. 23A is an explanatory diagram showing a force applied to the feeding roller and the arm member when the feeding roller is rotatingly driven in the forward direction.
Figure 23B:
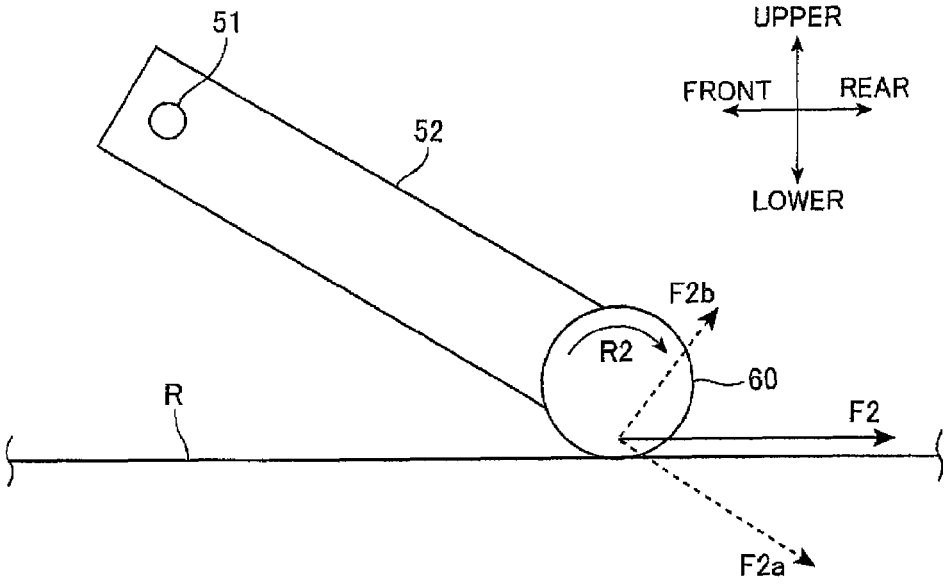
FIG. 23B is an explanatory diagram showing a force applied to the feeding roller and the arm member when the feeding roller is rotatingly driven in the reverse direction.

Since a certain play is given to the feeding roller 60 in the rotational direction, even when the LF motor 6 switches from the reverse direction to the forward direction, the feeding roller 60 is not immediately rotated in the reverse direction (the state in FIG. 6A) and, after a delay for the play, the feeding roller 60 is rotated (FIG. 6B) For this reason, it is prevented that pinching the recording medium between the conveying roller 71 and the follow roller 72 is prevented by the feeding roller 60. After the delay for the play, the feeding roller 60 is rotatingly driven in the reverse direction to convey the recording medium in the direction counter to the rotating direction of the conveying roller 71 (FIG. 7B). However, since the conveying force of the conveying roller 71 in the forward direction is greater than that of the feeding roller 60 in the reverse direction, conveying of the recording medium by the conveying roller 71 is not prevented. As shown in FIG. 23A, when the feeding roller 60 is rotatingly driven in the forward direction R1, a force F1 that makes the feeding roller 60 rollingly move frontward on the recording medium is generated. More specifically, the force F1 has a component force F1*a* parallel to the arm member 52 and a component force F1*b* perpendicular to the arm member 52. When the feeding roller 60 is rotated in the forward direction R1, since the component force F1*b* of the frontward force F1 acts as a force for pressing the feeding roller 60 toward the recording medium (i.e., a force for pivoting the arm member 52 downward), the pressing force is increased, thereby making the conveying force larger. In contrast, as shown in FIG. 23B, when the feeding roller 60 is rotated in the reverse direction R2, a force F2 that makes the feeding roller 60 rollingly move rearward on the recording medium is generated. The force F2 has a component force F2*a* parallel to the arm member 52 and a component force F2*b* perpendicular to the arm member 52. Since the component force F2*b* of the rearward force F2 acts as a force for separating the feeding roller 60 from the recording medium (i.e., a force for swinging the arm member 52 upward), the pressing force is decreased, thereby making the conveying force smaller. Thus, even when the feeding roller 60 is rotated in the reverse direction, conveying of the recording medium by the conveying roller 71 is not prevented.

In S105 the CPU 201 starts recording of an image on the recording medium. Specifically, the image is recorded by ejecting ink on the surface of the recording medium from the nozzles of the recording head 76 while intermittently moving the recording medium in the conveying direction and reciprocating the carriage 75 in the main scanning direction.

In S106 the CPU 201 determines whether or not the recording of one page (one recording medium) is finished. When the CPU 201 determines that recording of one page is finished, the CPU 201 proceeds to S107.

In S107, the recording medium on which the image is recorded is discharged to the front portion on the upper surface of the sheet feeding tray 30 (FIG. 2) Specifically, the LF motor 6 is rotated in the forward direction by the number of steps as necessary, and the conveying roller 71 and the discharge roller 77 are rotated in the forward direction by a predetermined amount.

In S108 the CPU 201 determines whether or not image recording data of next page for a subsequent recording medium exists. If the CPU 201 determines that the image recording data of the next page exists, the CPU 201 returns to S103 and the above-described process of S103 through S107 is repeated. If the CPU 201 determines that the image recording data of the next page does not exist, the image recording process ends.

If, in S101, the CPU 201 determines that the currently-set feed mode is not the intermittent feed mode but the continuous feed mode, in S109 the CPU 201 sets the power transmission switch mechanism 90 to the continuous-feed-mode transmission state. Specifically, the carriage 75 stopped at the first position PO1 is moved rightward (in the direction of the arrow E) by a predetermined distance and the contact piece 94*a* is pressed by the first engaging stepped part 75*a* of the carriage 75. When the contact piece 94*a* is located at the second setting part 101*d* (the second position PO2), the switch gear 93 engages with the continuous feed driving gear 112 and the rotational driving force is transmitted to the support shaft 51 via the intermediate gear 130 shown in FIGS. 18A through 18C. After that, even when the carriage 75 is moved leftward to the image recording area, the contact piece 94*a* urged by the first urging spring 96 is maintained at the second setting part 101*d*.

Figure 18A:
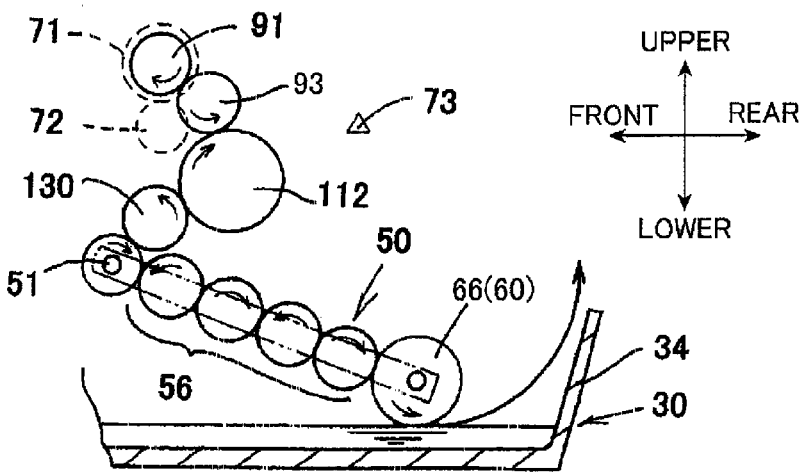
FIG. 18A is a schematic view for illustrating a transmission route of a rotational driving force in a continuous feed mode, where the uppermost recording medium is separated and conveyed to the conveying path.
Figure 18B:
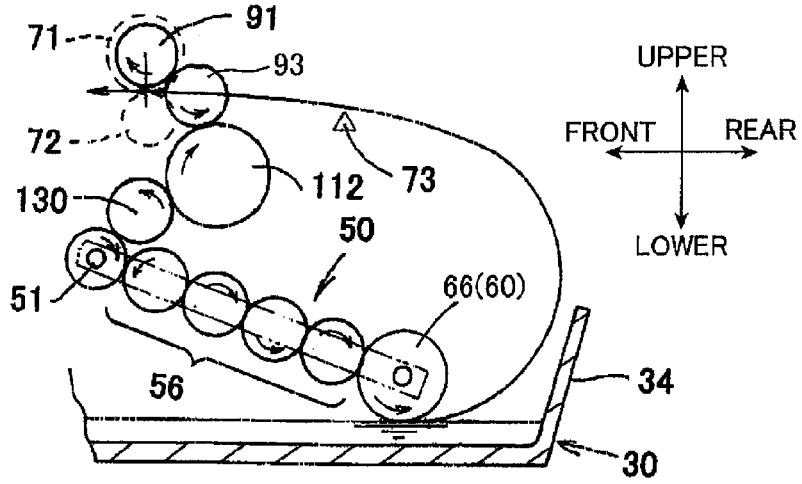
FIG. 18B is a schematic view for illustrating the transmission route of the rotational driving force in the continuous feed mode, where the recording medium is nipped at the nip part between the conveying roller and the follow roller and is also in contact with the feeding roller.
Figure 18C:
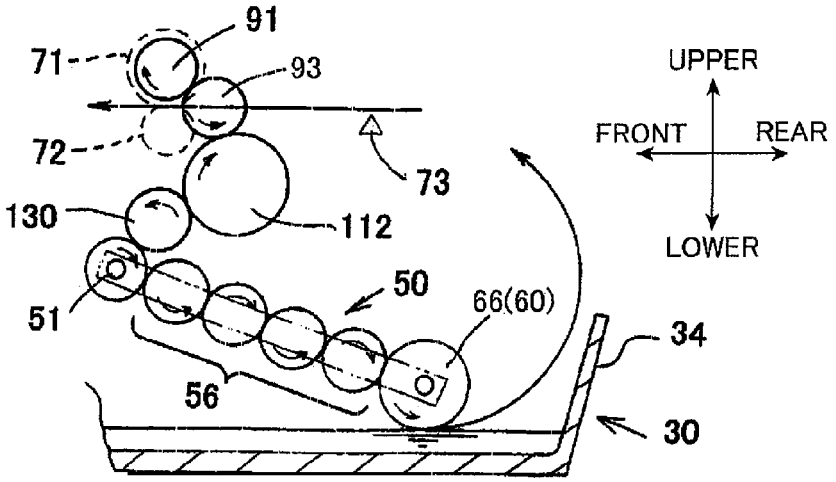
FIG. 18C is a schematic view for illustrating the transmission route of the rotational driving force in the continuous feed mode, where a previous recording medium (previous page) is discharged and next recording medium is continuously conveyed to a recording start position.
Figure 23C:
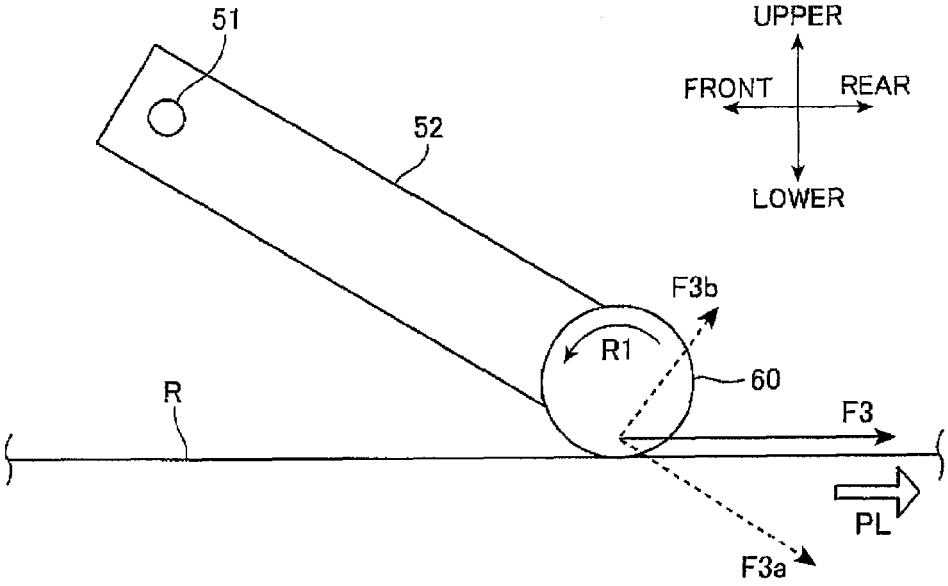
FIG. 23C is an explanatory diagram showing a force applied to the feeding roller and the arm member when the feeding roller is pulled by the recording medium in a rearward direction.

In S110 the recording medium is fed from the sheet feeding tray 30 to the image recording unit 70. Specifically, the CPU 201 controls the LF motor 6 to rotate in the forward direction, thereby driving the conveying roller 71 to rotate in the forward direction (in the clockwise direction in FIG. 18A) and driving the feeding roller 60 to rotate in the forward direction (in the counterclockwise direction in FIG. 18A). Thus, only the uppermost recording medium of a plurality of recording mediums accommodated in the sheet feeding tray 30 is separated and conveyed to the conveying path 5. At this time, since the conveying roller 71 is rotated in the forward direction, when the leading end of the recording medium reaches the nip part between the conveying roller 71 and the follow roller 72, the recording medium passes between the rollers 71 and 72 and is nipped at the nip part without being subject to registration function. Here, even when the recording medium is nipped at the nip part between the conveying roller 71 and the follow roller 72 and is also in contact with the feeding roller 60 as shown in FIG. 18B (the recording medium is located over both the rollers 60 and 71), conveying of the recording medium by the conveying roller 71 is not prevented. This is because, as described above, the conveying speed of the recording medium by the conveying roller 71 is faster than that of the recording medium by the feeding roller 60 and the feeding roller 60 is pulled by the recording medium. As shown in FIG. FIG. 23C, when the feeding roller 60 is pulled by the recording medium R in a direction PL, the recording medium R applies a rearward force F3 to the feeding roller 60. The rearward force F3 has a component force F3*a* parallel to the arm member 52 and a component force F3*b* perpendicular to the arm member 52. The component force F3*b* of the rearward force F3 acts as a force for separating the feeding roller 60 from the recording medium R (i.e., a force for swinging the arm member 52 upward). As a result, the pressing force is decreased, thereby making the conveying force smaller. Thus, although the conveying speed of the recording medium by the feeding roller 60 is lower than that of the conveying roller 71, conveying of the recording medium by the conveying roller 71 is not prevented and is performed smoothly.

In addition, in the image forming apparatus 1, it is prevented that slant of the recording medium is continuously generated by such continuous conveying. As described above, the conveying speed by the conveying roller 71 is faster than the conveying speed by the feeding roller 60. Thus, when the recording medium conveyed by the conveying roller 71 is also in contact with the feeding roller 60 (i.e., the recording medium is located over both the rollers 60 and 71), the feeding roller 60 is pulled by the recording medium and thus advances than the drive gear 66 by the above-described play in the rotational direction. In this state, when the trailing end of the recording medium conveyed by the conveying roller 71 is separated from the feeding roller 60, the feeding roller 60 comes into contact with the next (uppermost) recording medium. However, since the feeding roller 60 is an advanced state than the drive gear 66 by the play, the feeding roller 60 is not immediately rotated in the forward direction and, after delay for the play, is rotated in the forward direction. Consequently, it is prevented that slant of the recording medium is continuously generated by the continuous conveying of the recording mediums, which is caused by rotating both the feeding roller 60 and the conveying roller 71 in the forward direction.

In S111 the CPU 201 starts recording of an image on the recording medium. Specifically, the image is recorded by ejecting ink on the surface of the recording medium from the nozzles of the recording head 76 while intermittently moving the recording medium forward in the conveying direction and reciprocating the carriage 75 in the main scanning direction.

In S112 the CPU 201 determines whether or not image recording data of the next page (subsequent recording medium) exists. In S112, if the CPU 201 determines that the image recording data of the next page does not exist, in S113 the CPU 201 sets the power transmission switch mechanism 90 to the intermittent-feed-mode transmission state and proceeds to S114. If the CPU 201 determines that the image recording data of the next page exists, the CPU 201 proceeds to S114.

In S114 the CPU 201 determines whether or not recording of one page (one recording medium) is finished. If the CPU 201 determines that recording of one page is finished, the CPU 201 proceeds to S115.

In S115 the CPU 201 determines whether or not the power transmission switch mechanism 90 is in the continuous-feed-mode transmission state.

In S115, if the CPU 201 determines that the power transmission switch mechanism 90 is not in the continuous-feed-mode transmission state but in the intermittent-feed-mode transmission state, the CPU 201 proceeds to S116. After the CPU 201 executes a subsequent medium process in S116, the image recording process ends. Specific details of the subsequent medium process will be described later with reference to FIG. 22.

In S115, if the CPU 201 determines that the power transmission switch mechanism 90 is in the continuous-feed-mode transmission state (the image recording data of the next page exists), the CPU 201 proceeds to S117.

In S117, the recording medium on which the image is formed is discharged and the subsequent recording medium is conveyed, and then the CPU 201 returns to S111. Specifically, the LF motor 6 is continuously rotated in the forward direction, the previous recording medium (previous page) is discharged and the next recording medium is continuously conveyed to the recording start position (refer to FIG. 18C). In this manner, in the continuous feed node, since a plurality of recording mediums are continuously conveyed without temporarily stopping conveyance of the recording medium by the conveying roller 71, a high-speed recording operation can be achieved.

Figure 22:
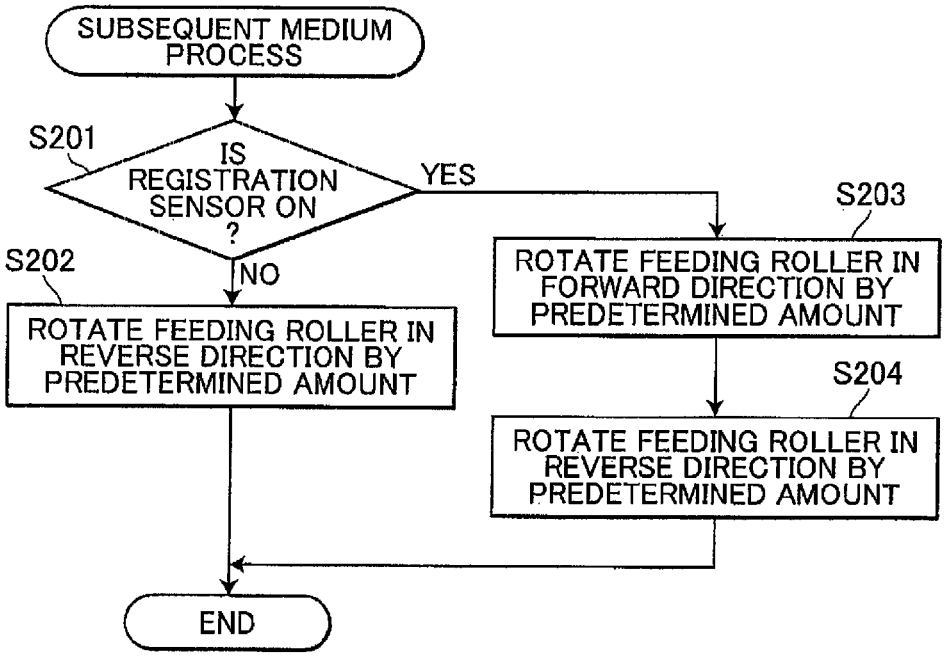
FIG. 22 is a flow chart of the subsequent medium process.

Next, the subsequent medium process executed in S116 in the above-described image recording process (FIG. 21) will be described with reference to a flow chart of FIG. 22.

When the subsequent medium process is started, in S201 the CPU 201 determines whether or not the registration sensor 73 is turned on. That is, the CPU 201 determines whether or not the leading end of the recording medium subsequent to the recording medium on which the image has been formed exceeds the position of the registration sensor 73.

In S201, if the CPU 201 determines that the registration sensor 73 is not turned on (is turned off), in S202 the CPU 201 controls the LF motor 6 to rotate in the forward direction by the number of steps as necessary, thereby rotating the feeding roller 60 in the reverse direction by a predetermined amount. Then, the subsequent medium process ends. As shown in FIG. 19A, when the leading end of the subsequent recording medium has not reached the position of the registration sensor 73, the subsequent recording medium is returned to the sheet feeding tray 30. The recording medium on which the image is recorded is discharged by rotation of the conveying roller 71 and the discharge roller 77 in the forward direction.

In S201, on the other hand, if the CPU 201 determines that the registration sensor 73 is turned on, the CPU 201 proceeds to S203. In S203 the CPU 201 controls the LF motor 6 to rotate in the reverse direction by the number of steps as necessary, thereby rotating the feeding roller 60 in the forward direction by a predetermined amount. That is, when the leading end of the subsequent recording medium exceeds the position of the registration sensor 73, the CPU 201 controls the feeding roller 60 to rotate in the forward direction, such that the leading end of the subsequent recording medium contacts the conveying roller 71 to perform slant correction.

In S204 the CPU 201 controls the LF motor 6 to rotate in the forward direction by the number of steps as necessary, thereby rotating the conveying roller 71 and the discharge roller 7 in the forward direction by a predetermined amount and rotating the feeding roller 60 in the reverse direction by a predetermined amount. Thus, as shown in FIG. 19B, the recording medium subjected to slant correction is discharged and the subsequent recording medium is returned to the sheet feeding tray 30. After that, the subsequent medium process ends.

As described above, when the leading end of the subsequent recording medium exceeds the position of the registration sensor 73 and is located downstream in the conveying direction, the subsequent recording medium is conveyed to the discharge side. In contrast, when the leading end of the subsequent recording medium does not reach the position of the registration sensor 73, the subsequent recording medium is returned to the sheet feeding tray 30.

[4. Effects of the Illustrative Aspects]

The image forming apparatus 1 in the above-described illustrative aspects is configured such that, in the intermittent feed mode, the recording medium conveyed by rotation of the feeding roller 60 in the forward direction is prohibited its passage by the conveying roller 71 rotating in the reverse direction and is subjected to slant correction. At the timing when the recording medium is conveyed by the feeding roller 60 and reaches the conveying roller 71, the forward or reverse direction of the rotational driving force generated by the LF motor 6 is switched (the CPU 201 which executes processing in S104 functions as a rotational direction switch controller), the conveying roller 71 is rotated in the forward direction and the recording medium subjected to slant correction is conveyed so as to pass through the conveying roller 71. On the other hand, since a certain play is given to the feeding roller 60 in the rotational direction, even when the forward or reverse direction of the rotational driving force generated by the LF motor 6 is switched, the feeding roller 60 is not immediately rotated in the reverse direction and after a delay for the play, the feeding roller 60 is rotated in the reverse direction. Thus, it is prevented that the recording medium is pulled back due to rotation of the feeding roller 60 in the reverse direction before the conveying roller 71 is ready to convey the recording medium. As a result, slant correction of the recording medium by the conveying roller 71 can be achieved without separating the feeding roller 60 from the recording medium or cutting off the transmission route for the rotational driving force to be in a free state.

In the above-described image forming apparatus 1, when the feeding roller 60 is rotatingly driven, a force that makes the feeding roller 60 rollingly move on the recording medium is applied to the arm member 52. More specifically, when the feeding roller 60 is rotatingly driven in the forward direction, a force that makes the feeding roller 60 rollingly move frontward on the recording medium is generated. Since a component force of the frontward force acts as a force for pressing the feeding roller 60 toward the recording medium, the pressing force is increased, thereby making the conveying force larger. In contrast, when the feeding roller 60 is rotated in the reverse direction, a force that makes the feeding roller 60 rollingly move rearward on the recording medium is generated. Since a component force of the rearward force acts as a force for separating the feeding roller 60 from the recording medium, the pressing force is decreased, thereby making the conveying force smaller. Consequently, when the feeding roller 60 is rotated in the forward direction, the image forming apparatus 1 can ensure a conveying force necessary for feeding the recording medium accommodated in the sheet feeding tray 30. On the other hand, when the feeding roller 60 is rotated in the reverse direction, conveying of the recording medium by the conveying roller 71 is not prevented.

In the image forming apparatus 1 in the above-described illustrative aspects, the feeding roller 60 rotates by the rotational driving force generated by the LF motor 6, thereby feeding (conveying) the recording medium accommodated in the sheet feeding tray 30 to the conveying path 5. Here, since an angle of the rotational axis of the feeding roller 60 has a certain flexibility (i.e., the angle of the rotational axis can change by a predetermined amount), a guiding action of the side end guides 31 and 32 (an action of preventing movement of the recording medium in a direction parallel to the rotational axis) has stronger effects than an inclination of the feeding roller 60, thereby making the conveying direction stable. That is, in a configuration in which the angle of the rotational axis of the feeding roller 60 does not have any flexibility (i.e., the angle of the rotational axis is fixed), when the feeding roller 60 contacts the recording medium accommodated in the recording-medium accommodating section in an inclined state, the recording medium tends to be conveyed in an inclined state due to factors such as such as dimension error and assembly error of the feeding roller 60 itself. Thus, even if the side end guides 31 and 32 are provided, the conveying direction of the recording medium by the feeding roller interferes with a guiding direction of the side end guides 31 and 32. As a result, when the effect of the feeding roller is greater, the recording medium is conveyed in the inclined state. In contrast, in the image forming apparatus 1 in the illustrative aspects, the feeding roller 60 is automatically located so that the recording medium can be smoothly conveyed in a normal conveying direction without interference with the side end guides 31 and 32, thereby stabilizing the conveying direction.

Further, in a configuration in which a rotational driving force generated by a driving unit is transmitted to an end of the feeding roller in the direction parallel to the rotational axis, providing flexibility in an angle of the rotational axis of the feeding roller worsens an inclination of the feeding roller. However, the image forming apparatus 1 in the illustrative aspects transmits the rotational driving force to a central part of the feeding roller in the direction parallel to the rotational axis, thereby preventing such worsening of the inclination of the feeding roller.

As described above, in the image forming apparatus 1 in the illustrative aspects, it is possible to effectively prevent a recording medium from being conveyed in an inclined state. Further, since the feeding roller 60 reliably contacts the recording medium, a sufficient conveying force can be obtained In addition, since an inclined contact (non-uniform contact) of the feeding roller 60 with the recording medium can be prevented, durability of the feeding roller 60 can be improved.

In the image forming apparatus 1 in the above-described illustrative aspects, the feeding roller 60 is rotatably supported by the free end of the arm member 52 that is swingable about the swing axis, and is rotated in a certain direction in contact with a recording medium accommodated in the feeding tray 30, thereby feeding (conveying) the recording medium to the conveying path 5. Because the first torsion coil spring 57 is provided at the base end of the arm member 52, the first torsion coil spring 57 can easily urge the arm member 52 downward in a wide swinging range (the entire swinging range), compared with a configuration in which the first torsion coil spring 57 is provided at the free end of the arm member 52. As the angle between the plane containing the rotational axis and the swing axis between the surface of the recording medium accommodated in the feeding tray 30 becomes smaller, the conveying force of the feeding roller 60 for conveying the recording medium also becomes smaller. In the illustrative aspects, however, necessary conveying force can be obtained because the arm member 52 is urged by the second torsion coil spring 58 when the angle is small.

Especially, in the image forming apparatus 1, the second torsion coil spring 58 urges the free end of the arm member 52 Hence, in comparison with a configuration of urging the swing axis side of the arm member 52, an urging force (elastic force) of the second torsion coil spring 58 can be made smaller. In addition, the angle at which the second torsion coil spring 58 starts applying its force can be set relatively accurately.

In addition, in the image forming apparatus 1, with a simple configuration in which the second tray 40 is disposed above the feeding tray 30, the recording medium accommodated in the second tray 40 (not the recording medium in the feeding tray 30) can be fed (conveyed) to the conveying path 5. Further, since the second torsion coil spring 58 applies its urging force when the recording medium accommodated in the second tray 40 is conveyed, necessary conveying force can be obtained and thus, the recording medium can be reliably conveyed. Especially, in the image forming apparatus 1, the recording medium accommodated in the second tray 40 is conveyed along the conveying path 5 with a smaller radius of rotation than the recording medium accommodated in the feeding tray 30. In addition, since thick and small-sized recording mediums such as postcards and envelopes are accommodated in the second tray 40, a larger conveying force is required in comparison with a case of conveying the recording medium accommodated in the feeding tray 30. However, this requirement is satisfied by setting an appropriate pressing force (urging force) of the second torsion coil spring 58.

According to the image forming apparatus 1 in the illustrative aspects, it is possible to set independently a pressing force for pressing the recording medium accommodated in the feeding tray 30 (a pressing force by the first torsion coil spring 57) and a pressing force for pressing the recording medium accommodated in the second tray 40 (a combined pressing force by the first torsion coil spring 57 and second torsion coil spring 58). Thus, a user can use the feeding tray 30 and the second tray 40 depending on recording mediums that require different conveying forces due to differences in a surface condition, thickness, or the like.

While the invention has been described in detail with reference to the above aspects thereof, it would be apparent to those skilled in the art that various changes and modifications may be made therein without departing from the spirit of the invention.

For example, in the above-described image forming apparatus 1, a gap is formed between the shaft part 65 of the feeding roller 60 and the axial support part 55 of the arm member 52, allowing flexibility in the angle of the rotational axis of the feeding roller 60. However, means for giving flexibility is not, limited to this configuration. For example, the free end (rear end) of the arm member 52 that supports the feeding roller 60 may be configured to move relative to the other part of the arm member 52. In this configuration, the free end (rear end) of the arm member 52 can be moved relative to the other part of the arm member 52, allowing the angle of the rotational axis of the feeding roller 60 to be changed relative to a reference position. Alternatively, the flexibility given to the angle of the rotational axis of the feeding roller 60 may be flexibility either on angles in all directions as in the above-described image forming apparatus 1 or on an angle in a certain direction. The angle in a certain direction includes an angle along a plane parallel to the recording medium (i.e., an angle in the front-rear direction) and an angle along a plane perpendicular to the recording medium (i.e., an angle in the vertical direction), for example.

Further, in the above-described image forming apparatus 1, the second torsion coil spring 57 provided at a base end (front end) of the arm member 52 comes into contact with the frame 4 and elastically deforms, thereby urging the arm member 52. However, the invention is not limited to this configuration For example, a spring may be provided at the frame 4, such that the spring contacts the arm member 52 and elastically deforms, thereby urging the arm member 52.

Furthers in the above-described illustrative aspects, the invention is applied to an image forming apparatus for recording an image by an inkjet method. However, the invention is not limited to this configuration and, for example, can be applied to an image forming apparatus for recording an image by a laser method.

What is claimed is:

1. An image forming apparatus comprising:

a main body;

a recording-medium accommodating section that is provided at the main body and that is configured to accommodate a recording medium;

a feeding roller disposed to be in contact with the recording medium accommodated in the recording-medium accommodating section, the feeding roller being configured to be driven to rotate both in a forward direction for conveying the recording medium to an image forming position along a conveying path and in a reverse direction opposite to the forward direction;

a conveying roller disposed on the conveying path, the conveying roller being configured to be driven to rotate both in a forward direction for allowing passage of the recording medium conveyed by the feeding roller and in a reverse direction for preventing the passage of the recording medium, the reverse direction being opposite to the forward direction;

a driving unit that is configured to generate a rotational driving force in both directions; and a transmitting unit configured to transmit the rotational driving force to the feeding roller and the conveying roller, in such a manner that when the feeding roller rotates in the forward direction, the conveying roller rotates in the reverse direction, and when the feeding roller rotates in the reverse direction, the conveying roller rotates in the forward direction, wherein the feeding roller has a predetermined play in a rotational direction with respect to the transmitting unit, thereby delaying a start of reverse rotation of the feeding roller relative to a start of a forward rotation of the conveying roller.

2. The image forming apparatus according to claim 1, further comprising a supporting member that is swingable about an imaginary swing axis that is parallel to an imaginary rotational axis of the feeding roller, the imaginary swing axis being located above the recording medium accommodated in the recording-medium accommodating section and being located upstream in a feeding direction of the recording medium with respect to the imaginary rotational axis.

3. The image forming apparatus according to claim 2, wherein the transmitting unit comprises a drive gear provided at a free end of the supporting member, the free end being an opposite end to the imaginary swing axis, the drive gear being formed with a through-hole having a cross section formed of a circular portion and a pair of fan-shaped notched parts formed at opposing positions on an outer circumference of the circular portion;

wherein the feeding roller comprises a shaft part that, is inserted into the through-hole of the drive gear, the shaft part having a cross section formed of a circular portion and a pair of protrusions formed at opposing positions on an outer circumference of the circular portion; and wherein a length in a circumferential direction of the pair of fan-shaped notched parts is larger than a length in the circumferential direction of the pair of protrusions, allowing the feeding roller to have the predetermined play in the rotational direction with respect to the drive gear.

4. The image forming apparatus according to claim 1, wherein the transmitting unit comprises:

a switch gear that receives the rotational driving force from the conveying roller the switch gear being slidable in a sliding direction; and a plurality of gears that is selectively engaged with the switch gear depending on a sliding position of the switch gear, thereby enabling a plurality of transmission modes.

5. The image forming apparatus according to claim 4, wherein the plurality of gears comprises:

an intermittent feed driving gear that enables an intermittent feed mode in which either one of the feeding roller and the conveying roller rotates in the forward direction and the other one of the feeding roller and the conveying roller rotates in the reverse direction; and a continuous feed driving gear that enables a continuous feed mode in which both of the feeding roller and the conveying roller rotate in the forward direction.

6. The image forming apparatus according to claim 1, wherein a conveying speed of the recording medium by the conveying roller is higher than a conveying speed of the recording medium by the feeding roller.

7. An image forming apparatus comprising:

a main body;

a recording-medium accommodating section that is provided at the main body and that is configured to accommodate a recording medium;

a feeding roller disposed to be in contact with the recording medium accommodated in the recording-medium accommodating section, the feeding roller being configured to be driven to rotate both in a forward direction for conveying the recording medium to an image forming position along a conveying path and in a reverse direction opposite to the forward direction;

a conveying roller disposed on the conveying path, the conveying roller being configured to driven to rotate both in a forward direction for allowing passage of the recording medium conveyed by the feeding roller and in a reverse direction for preventing the passage of the recording medium, the reverse direction being opposite to the forward direction;

a driving unit that is configured to generate a rotational driving force in both directions;

a transmitting unit that is capable of transmitting the rotational driving force to the feeding roller and the conveying roller, in such a manner that either one of the feeding roller and the conveying roller rotates in the forward direction and that the other one of the feeding roller and the conveying roller rotates in the reverse direction; and a supporting member that is swingable about an imaginary swing axis that is parallel to an imaginary rotational axis of the feeding roller, the imaginary swing axis being located above the recording medium accommodated in the recording-medium accommodating section and being located upstream in a feeding direction of the recording medium with respect to the imaginary rotational axis, wherein the feeding roller has a predetermined play in a rotational direction;

wherein the transmitting unit comprises a drive gear provided at a free end of the supporting member, the free end being an opposite end to the imaginary swing axis, the drive gear being formed with a through-hole having a cross section formed of a circular portion and a pair of fan-shaped notched parts formed at opposing positions on an outer circumference of the circular portion;

wherein the feeding roller comprises a shaft part that is inserted into the through-hole of the drive gear, the shaft part having a cross section formed of a circular portion and a pair of protrusions formed at opposing positions on an outer circumference of the circular portion; and wherein a length in a circumferential direction of the pair of fan-shaped notched parts is larger than a length in the circumferential direction of the pair of protrusions, allowing the feeding roller to have the predetermined play in the rotational direction with respect to the drive gear.

* * * * *